United States Patent [19]

Nishijima et al.

[11] Patent Number: 4,675,275

[45] Date of Patent: Jun. 23, 1987

[54] SILVER HALIDE COLOR PHOTOGRAPHIC MATERIAL OF IMPROVED REPRODUCIBILITY

[75] Inventors: Toyoki Nishijima; Kaoru Onodera, both of Odawara, Japan

[73] Assignee: Konishiroku Photo Industry Co., Ltd., Tokyo, Japan

[21] Appl. No.: 812,236

[22] Filed: Dec. 23, 1985

[30] Foreign Application Priority Data

Dec. 29, 1984 [JP] Japan ..... 59-276724

[51] Int. Cl.[4] ..... G03C 7/40; G03C 7/26

[52] U.S. Cl. ..... 430/372; 430/551; 430/558

[58] Field of Search ..... 430/551, 558, 554, 555, 430/372, 386

[56] References Cited

U.S. PATENT DOCUMENTS 4,540,653 9/1985 Nishijima et al. ..... 430/551

4,581,326 4/1986 Katoh et al. ..... 430/551

*Primary Examiner*—John L. Goodrow

*Attorney, Agent, or Firm*—Frishauf, Holtz, Goodman & Woodward

[57] ABSTRACT

There is disclosed a light-sensitive silver halide photographic material which comprises at least one coupler represented by the formula (I) shown below, at least one of the compounds represented by the formulae (XI), (XII) and (XIII) shown below and at least one of the compounds represented by the formulae (XXI), (XXII) and (XXIII) shown below:

(I)

wherein Z, X and R have the same meanings as defined in the specification, (XI)

-continued (XII)

(XIII)

wherein M, $X^3$, Y, $R^1$, $R^2$, $R^3$, $R^4$ and $Z^0$ have the same meanings as defined in the specification, (XXI)

(XXII)

(XXIII)

wherein $R_{1)}$, J, $R_{2)}$, $R_{3)}$, $R_{4)}$, $R_{5)}$, $R_{6)}$, $R_{7)}$, $R_{8)}$, $R_{9)}$ and $R_{10)}$ have the same meanings as defined in the specification.

24 Claims, No Drawings

SILVER HALIDE COLOR PHOTOGRAPHIC MATERIAL OF IMPROVED REPRODUCIBILITY

BACKGROUND OF THE INVENTION

This invention relates to a light-sensitive silver halide photographic material, particularly to a light-sensitive silver halide photographic material improved in color reproducibility.

As the method for forming a dye image by use of a light-sensitive color photographic material, there may be mentioned the method in which a dye is formed through the reaction between a coupler and the oxidized product of a color developing agent. For the coupler for effecting ordinary color reproduction, the respective couplers of magenta, yellow and cyan, while for the color developing agent, an aromatic primary amine type color developing agent, have been recommended to be used, respectively. Through the reaction of the respective couplers of magenta and yellow with the oxidized product of an aromatic primary amine type color developing agent, dyes such as azomethyne dye, etc. are formed, and through the reaction of a cyan coupler with the oxidized product of an aromatic primary amine type color developing agent, dyes such as indoaniline dye, etc. are formed.

Among them, for formation of a magenta color image, 5-pyrazolone, cyanoacetophenone, indazolone, pyrazolobenzimidazole, pyrazolotriazole type couplers, etc. may be used.

In the prior art, most of the magenta color image forming couplers practically used have been 5-pyrazolone type couplers. The color image formed from a 5-pyrazolone type coupler, although it is excellent in fastness to light and heat, is not satisfactory in the tone of the dye, with unnecessary absorption of the yellow component existing at around 430 nm and also the absorption spectrum of visible light at around 550 nm being broad, whereby color turbidity may be caused to give a photographic image lacking in clearness.

As the coupler having no such unnecessary absorption, 1H-pyrazolo[3,2-c]-s-triazole type coupler, 1H-imidazo[1,2-b]-pyrazole type coupler, 1H-pyrazolo[1,5-b]pyrazole type coupler or 1H-pyrazolo[1,5-d]tetrazole type coupler as disclosed in U.S. Pat. No. 3,725,067; Japanese Provisional Patent Publications No. 162548/1984 and No. 171956/1984 are particularly excellent.

However, the dye color images formed from these couplers have reduced fastness to light. When these couplers are used for light-sensitive materials, particularly those suitable for direct viewing, the necessary conditions essentially required for photographic materials of recording and storage of images will be impaired.

Thus, the prior art couples involved drawbacks in practical application. Accordingly, as the method improving light resistance, it has been proposed to use a phenol type or phenylether type antioxidant, as disclosed in Japanese Provisional Patent Publication No. 125732/1984. However, no satisfactory effect of improving light resistance could be obtained.

SUMMARY OF THE INVENTION

In view of the above situation, a first object of the present invention is to provide a light-sensitive silver halide photographic material which is excellent in light fastness of magenta image.

The second object of the present invention is to provide a light-sensitive silver halide photographic material which is improved in light fastness of magenta image which is formed using at least one of the aforesaid couplers and without decrease of photographic characteristics such as sensitivity, gradiation, whiteness, etc.

The third object of the present invention is to provide a light-sensitive silver halide photographic material which is improved in color reproducibility of magenta image and good in light fastness of the magenta image.

The above objects of the present invention have been accomplished by a light-sensitive silver halide photographic material, containing at least one coupler represented by the formula (I) shown below; at least one of the compounds represented by the formulae (XI), (XII) and (XIII) shown below; and further at least one of the compounds represented by the formulae (XXI), (XII) and (XXIII):

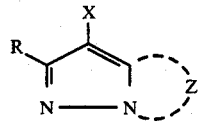

(I)

In the formula, Z represents a group of non-metallic atoms necessary for forming a nitrogen-containing heterocyclic ring which may have a substituent; X represents a hydrogen atom or a substituent eliminatable through the reaction with the oxidized product of a color developing agent; and R represents a hydrogen atom or a substituent.

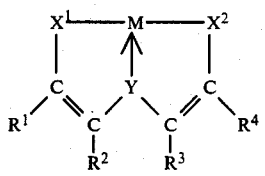

(XI)

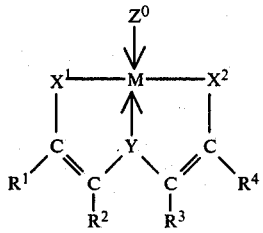

(XII)

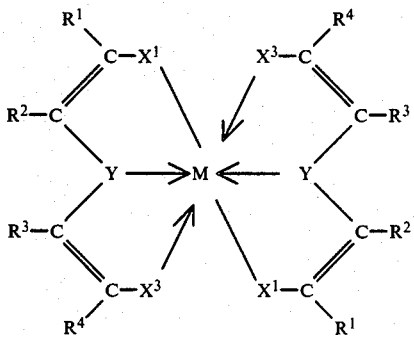

(XIII)

In the above formulae (XI), (XII) and (XIII), M represents a metal atom; $X^1$ and $X^2$ each represent an oxygen atom, a sulfur atom or —$NR^5$— ($R^5$ represents a hydrogen atom, an alkyl group, an aryl group or a hydroxyl group); $X^3$ represents a hydroxyl group or a mercapto group; Y represents an oxygen atom or a sulfur atom; $R^1$, $R^2$, $R^3$ and $R^4$ each represent a hydrogen atom, a halogen atom, a cyano group, or an alkyl group, an aryl group, a cycloalkyl group or a heterocyclic group each of which are bonded to a carbon atom directly or via a divalent linking group, provided that at least one of the combination of $R^1$ and $R^2$, and $R^3$ and $R^4$ may form a 5- or 6-membered ring with a carbon atom which is linked and bonded to each other; and $Z^0$ represents a compound capable of coordinating to M or its residual group.

(XXI)

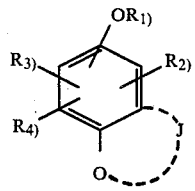

(XXII)

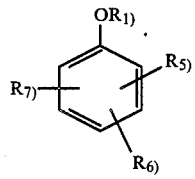

(XXIII)

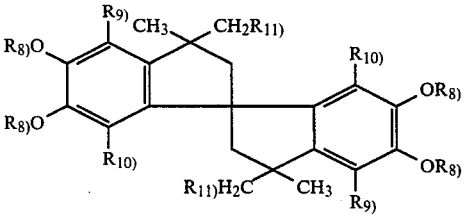

In the above formulae (XXI) and (XXII), $R_{(1)}$ represents a hydrogen atom, an alkyl group, an acyl group, a sulfonyl group, a carbamoyl group, a sulfamoyl group, an alkoxycarbonyl group or a trialkylsilyl group; J represents a group of non-metallic atoms necessary for forming a 5- or 6-membered ring with a carbon atom or an oxygen atom to be bonded and wherein said 5- or 6-membered ring may have a bis-spiro bond; $R_{(2)}$, $R_{(3)}$ and $R_{(4)}$ each represent a hydrogen atom, an alkyl group, an alkoxy group, an aryl group, an aryloxy group, an alkenyl group, an alkenoxy group, an acylamino group, a halogen atom, an alkylthio group, an arylthio group, an alkoxycarbonyl group, an acyloxy group, an acyl group or a sulfonamide group, and these groups represented by the $R_{(2)}$, $R_{(3)}$ and $R_{(4)}$ may be the same or different from each other; $R_{(5)}$, $R_{(6)}$ and $R_{(7)}$ each represent a hydrogen atom, a hydroxy group, an alkyl group, an alkenyl group, an alkoxy group, an aryl group, an aryloxy group, an acyloxy group or an alkoxycarbonyl group, provided that the total carbon number of $R_{(5)}$ to $R_{(7)}$ is 8 or more, and these groups represented by the $R_{(5)}$, $R_{(6)}$ and $R_{(7)}$ may be the same or different from each other.

In the formula (XXIII), $R_{(8)}$ represents an alkyl group, an alkenyl group, an aryl group, a heterocyclic group, a $R_{(12)}$—CO— group, a $R_{(13)}$—$SO_2$— group or a $R_{(14)}$—NHCO— group; $R_{(9)}$ and $R_{(10)}$ each represent a hydrogen atom, a halogen atom, an alkyl group, an alkenyl group, an alkoxy group or an alkenoxy group; $R_{(11)}$ represents a hydrogen atom, an alkyl group, an alkenyl group or an aryl group; $R_{(12)}$, $R_{(13)}$ and $R_{(14)}$ each represent an alkyl group, an alkenyl group, an aryl group or a heterocyclic group.

DESCRIPTION OF THE PREFERRED EMBODIMENTS

The present invention is described in detail below.

In the magenta coupler according to the present invention represented by the above (I), (I)

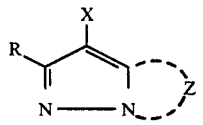

where R represents a hydrogen atom or a substituent, as the substitutent represented by R, there may be mentioned, for example, halogen atoms, an alkyl group, a cycloalkyl group, an alkenyl group, a cycloalkenyl group, an alkynyl group, an aryl group, a heterocyclic group, an acyl group, a sulfonyl group, a sulfinyl group, a phosphonyl group, a carbamoyl group, a sulfamoyl group, a cyano group, a spiro compound residual group, a bridged hydrocarbon compound residual group, an alkoxy group, an aryloxy group, a heterocyclicoxy group, a siloxy group, an acyloxy group, a carbamoyloxy group, an amino group, an acylamino group, a sulfonamide group, an imide group, an ureido group, a sulfamoylamino group, an alkoxycarbonylamino group, an aryloxycarbonylamino group, an alkoxycarbonyl group, an aryloxycarbonyl group, an alkylthio group, an arylthio group and a heterocyclicthio group.

As halogen atoms, for example, chlorine atom, bromine atom may be used, particularly preferably chlorine atom.

The alkyl group represented by R may include preferably those having 1 to 32 carbon atoms, the alkenyl group or the alkynyl group those having 2 to 32 carbon atoms and the cycloalkyl group or the cycloalkenyl group those having 3 to 12 carbon atoms, particularly 5 to 7 carbon atoms. The alkyl group, alkenyl group or alkynyl group may be either straight or branched.

The alkyl group, alkenyl group, alkynyl group, cycloalkyl group and cycloalkenyl group may also have substituents [e.g. an aryl group, a cyano group, a halogen atom, a heterocyclic ring, a cycloalkyl group, a cycloalkenyl group, a spiro ring compound residual group, a bridged hydrocarbon compound residual group; or maybe substituted through a carbonyl group such as an acyl group, a carboxy group, a carbamoyl group, an alkoxycarbonyl group and an aryloxycarbonyl group; further maybe substituted through groups containing a hetero atom, specifically those substituted through an oxygen atom such as of a hydroxy group, an alkoxy group, an aryloxy group, a heterocyclicoxy group, a siloxy group, an acyloxy group, a carbamoyloxy group, etc.; groups substituted through a nitrogen atom such as a nitro group, an amino (including a dialkylamino group, etc.), a sulfamoylamino group, an alkoxycarbonylamino group, an aryloxycarbonylamino group, an acylamino group, a sulfonamide group, an imide group, an ureido group, etc.; those substituted through a sulfur atom such as of an alkylthio group, an arylthio group, a heterocyclicthio group, a sulfonyl group, a sulfinyl group, a sulfamoyl group, etc.; and groups substituted through a phosphorus atom such as of a phosphonyl group, etc.].

More specifically, there may be included, for example, a methyl group, an ethyl group, an isopropyl group, a t-butyl group, a pentadecyl group, a heptadecyl group, a 1-hexylnonyl group, a 1,1'-dipentylnonyl group, a 2-chloro-t-butyl group, a trifluoromethyl group, a 1-ethoxytridecyl group, a 1-methoxyisopropyl group, a methanesulfonylethyl group, a 2,4-di-t-amylphenoxymethyl group, an anilino group, a 1-phenylisopropyl group, a 3-m-butanesulfoneaminophenoxypropyl group, a 3,4'-{α-[4''-(p-hydroxybenzenesulfonyl)-phenoxy]dodecanoylamino}phenylpropyl group, a 3-{4'-[α-(2'',4''-di-t-amylphenoxy)butaneamido]phenyl}propyl group, a 4-[α-(o-chlorophenoxy)tetradecaneamidophenoxy]propyl group, an allyl group, a cyclopentyl group, a cyclohexyl group, and so on.

The aryl group represented by R may preferably be a phenyl group, which may also have a substituent (e.g. an alkyl group, an alkoxy group, an acylamino group, etc.).

More specifically, there may be included a phenyl group, a 4-t-butylphenyl group, a 2,4-di-t-amylphenyl group, a 4-tetradecaneamidophenyl group, a hexadecyloxyphenyl group, a 4'-[α-(4''-t-butylphenoxy)tetradecaneamido]phenyl group and the like.

The heterocyclic group represented by R may preferably be a 5- or 7-membered ring, which may either be substituted or fused. More specifically, a 2-furyl group, a 2-thienyl group, a 2-pyrimidinyl group, a 2-benzothiazolyl group, etc. may be mentioned.

The acyl group represented by R may be, for example, an alkylcarbonyl group such as an acetyl group, a phenylacetyl group, a dodecanoyl group, an α-2,4-di-t-amylphenoxybutanoyl group and the like; an arylcarbonyl group such as a benzoyl group, a 3-pentadecyloxybenzoyl group, a p-chlorobenzoyl group and the like.

The sulfonyl group represented by R may include alkylsulfonyl groups such as a methylsulfonyl group, a dodecylsulfonyl group and the like; arylsulfonyl groups such as a benzenesulfonyl group, a p-toluenesulfonyl group and the like.

Examples of the sulfinyl groups represented by R are alkylsulfinyl groups such as an ethylsulfinyl group, an octylsulfinyl group, a 3-phenoxybutylsulfinyl group and the like; arylsulfinyl groups such as a phenylsulfinyl group, a m-pentadecylphenylsulfinyl group and the like.

The phosphonyl group represented by R may be exemplified by alkylphosphonyl groups such as a butyloctylphoshonyl group and the like; alkoxyphosphonyl groups such as an octyloxyphosphonyl group and the like; aryloxyphosphonyl groups such as a phenoxyphosphonyl group and the like; and arylphosphonyl groups such as a phenylphosphonyl group and the like.

The carbamoyl group represented by R may be substituted by an alkyl group, an aryl group (preferably a phenyl group), etc., including, for example, an N-methylcarbamoyl group, an N,N-dibutylcarbamoyl group, an N-(2-pentadecyloctylethyl)carbamoyl group, an N-ethyl-N-dodecylcarbamoyl group, an N-{3-(2,4-di-t-amylphenoxy)propyl}carbamoyl group and the like.

The sulfamoyl group represented by R may be substituted by an alkyl group, an aryl group (preferably a phenyl group) etc., including, for example, an N-propylsulfamoyl group, an N,N-diethylsulfamoyl group, an N-(2-pentadecyloxyethyl)sulfamoyl group, an N-ethyl-N-dodecylsulfamoyl group, an N-phenylsulfamoyl group and the like.

The spiro compound residue represented by R may be, for example, spiro[3.3]heptan-1-yl and the like.

The bridged hydrocarbon residual group represented by R may be, for example, bicyclo[2.2.1]heptan-1-yl, tricyclo[3.3.1.1$^{3,7}$]decan-1-yl, 7,7-dimethylbicyclo[2.2.1]heptan-1-yl and the like.

The alkoxy group represented by R may be substituted by those groups as mentioned above as substituents for alkyl groups, including a methoxy group, a propoxy group, a 2-ethoxyethoxy group, a pentadecyloxy group, a 2-dodecyloxyethoxy group, a phenethyloxyethoxy group and the like.

The aryloxy group represented by R may preferably be a phenyloxy group of which the aryl nucleus may be further substituted by those groups mentioned above as substituents or atoms for the aryl groups, including, for example, a phenoxy group, a p-t-butylphenoxy group, a m-pentadecylphenoxy group and the like.

The heterocyclicoxy group represented by R may preferably be one having a 5- to 7-membered hetero ring, which hetero ring may further have substituents, including a 3,4,5,6-tetrahydropyranyl-2-oxy group, a 1-phenyltetrazole-5-oxy group and the like.

The siloxy group represented by R may further be substituted by an alkyl group, etc., including a siloxy group, a trimethylsiloxy group, a triethylsiloxy group, a dimethylbutylsiloxy group and the like.

The acyloxy group represented by R may be exemplified by an alkylcarbonyloxy group, an arylcarbonyloxy group, etc., which may further have substituents, including specifically an acetyloxy group, an α-chloroacetyloxy group, a benzoyloxy and the like.

The carbamoyloxy group represented by R may be substituted by an alkyl group, an aryl group, etc., including an N-ethylcarbamoyloxy group, an N,N-diethylcarbamoyloxy group, an N-phenylcarbamoyloxy group and the like.

The amino group represented by R may be substituted by an alkyl group, an aryl group (preferably a phenyl group), etc., including an ethylamino group, an anilino group, a m-chloroanilino group, a 3-pentadecyloxycarbonylanilino group, a 2-chloro-5-hexadecaneamidoanilino group and the like.

The acylamino group represented by R may include an alkylcarbonylamino group, an arylcarbonylamino group (preferably a phenylcarbonylamino group), etc., which may further have substituents, specifically an acetamide group, an α-ethylpropaneamide group, an N-phenylacetamide group, a dodecaneamide group, a 2,4-di-t-amylphenoxyacetoamide group, an α-3-t-butyl-4-hydroxyphenoxybutaneamide group and the like.

The sulfonamide group represented by R may include an alkylsulfonylamino group, an arylsulfonylamino group, etc., which may further have substituents, specifically a methylsulfonylamino group, a pentadecylsulfonylamino group, a benzenesulfonamide group, a p-toluenesulfonamide group, a 2-methoxy-5-t-amylbenzensulfonamide and the like.

The imide group represented by R may be either open-chained or cyclic, and may also have substituents, as exemplified by a succinimide group, a 3-heptadecylsuccinimide group, a phthalimide group, a glutarimide group and the like.

The ureido group represented by R may be substituted by an alkyl group, an aryl group (preferably a phenyl group), etc., including an N-ethylureido group, an N-methyl-N-decylureido group, an N-phenylureido group, an N-p-tolylureido group and the like.

The sulfamoylamino group represented by R may be substituted by an alkyl group, an aryl group (preferably a phenyl group), etc., including an N,N-dibutylsulfamoylamino group, an N-methylsulfamoylamino group, an N-phenylsulfamoylamino group and the like.

The alkoxycarbonylamino group represented by R may further have substituents, including a methoxycarbonylamino group, a methoxyethoxycarbonylamino group, an octadecyloxycarbonylamino group and the like.

The aryloxycarbonylamino group represented by R may have substituents, and may include a phenoxycarbonylamino group, a 4-methylphenoxycarbonylamino group and the like.

The alkoxycarbonyl group represented by R may further have substituents, and may include a methoxycarbonyl group, a butyloxycarbonyl group, a dodecyloxycarbonyl group, an octadecyloxycarbonyl group, an ethoxymethoxycarbonyloxy group, an benzyloxycarbonyl group and the like.

The aryloxycarbonyl group represented by R may further have substituents, and may include a phenoxycarbonyl group, a p-chlorophenoxycarbonyl group, a m-pentadecyloxyphenoxycarbonyl group and the like.

The alkylthio group represented by R may further have substituents, and may include an ethylthio group, a dodecylthio group, an octadecylthio group, a phnethylthio group, a 3-phenoxypropylthio group and the like.

The arylthio group represented by R may preferably be a phenylthio group, which may further have substituents, and may include, for example, a phenylthio group, a p-methoxyphenylthio group, a 2-t-octylphenylthio group, a 3-octadecylphenylthio group, a 2-carboxyphenylthio group, a p-acetaminophenylthio group and the like.

The heterocyclicthio group represented by R may preferably be a 5- to 7-membered heterocyclicthio group, which may further have a fused ring or have substituents, including, for example, a 2-pyridylthio group, a 2-benzothiazolylthio group, a 2,4-di-phenoxy-1,3,5-triazole-6-thio group and the like.

The atom eliminatable through the reaction with the oxidized product of the color developing agent represented by X may include halogen atoms (e.g. a chlorine atom, a bromine atom, a fluorine atom, etc.) and also groups substituted through a carbon atom, an oxygen atom, a sulfur atom or a nitrogen atom.

The group substituted through a carbon atom may include the groups represented by the formula:

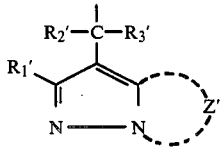

wherein $R_1'$ has the same meaning as the above R, Z' has the same meaning as the above Z, $R_2'$ and $R_3'$ each represent a hydrogen atom, an aryl group, an alkyl group or a heterocyclic group, a hydroxymethyl group and a triphenylmethyl group.

The group substituted through an oxygen atom may include an alkoxy group, an aryloxy group, a heterocyclicoxy group, an acyloxy group, a sulfonyloxy group, an alkoxycarbonyloxy group, an aryloxycarbonyloxy group, an alkyloxalyloxy group, an alkoxyoxalyloxy groups.

Said alkoxy group may further have substituents, including an ethoxy group, a 2-phenoxyethoxy group, a 2-cyanoethoxy group, a phenethyloxy group, a p-chlorobenzyloxy group and the like. Said aryloxy group may preferably be a phenoxy group, which aryl group may further have substituents. Specific examples may include a phenoxy group, a 3-methylphenoxy group, a 3-dodecylphenoxy group, a 4-methanesulfonamidophenoxy group, a 4-[α-(3'-pentadecylphenoxy)-butaneamido]phenoxy group, a hexadecylcarbamoylmethoxy group, a 4-cyanophenoxy group, a 4-methanesulfonylphenoxy group, a 1-naphthyloxy group, a p-methoxyphenoxy group and the like.

Said heterocyclicoxy group may preferably be a 5- to 7-membered heteroxyclicoxy group, which may be a fused ring or have substituents. Specifically, a 1-phenyltetrazolyloxy group, a 2-benzothiazolyloxy group and the like may be included.

Said acyloxy group may be exemplified by an alkylcarbonyloxy group such as an acetoxy group, a butanoyloxy group, etc.; an alkenylcarbonyloxy group such as a cinnamoyloxy group; an arylcarbonyloxy group such as a benzoyloxy group.

Said sulfonyloxy group may be, for example, a butanesulfonyloxy group, a methanesulfonyloxy group and the like. Said alkoxycarbonyloxy group may be, for example, an ethoxycarbonyloxy group, a benzyloxycarbonyloxy group and the like.

Said aryloxycarbonyl group may be, for example, a phenoxycarbonyloxy group and the like.

Said alkyloxalyloxy group may be, for example, a methyloxalyloxy group.

Said alkoxyoxalyloxy group may be, for example, an ethoxyoxalyloxy group and the like.

The group substituted through a sulfur atom may include an alkylthio group, an arylthio group, a heterocyclicthio group, an alkyloxythiocarbonylthio groups.

Said alkylthio group may include a butylthio group, a 2-cyanoethylthio group, a phenethylthio group, a benzylthio group and the like.

Said arylthio group may include a phenylthio group, a 4-methanesulfonamidophenylthio group, a 4-dodecylphenethylthio group, a 4-nonafluoropentaneamidophenethylthio group, a 4-carboxyphenylthio group, a 2-ethoxy-5-t-butylphenylthio group and the like.

Said heterocyclicthio group may be, for example, a 1-phenyl-1,2,3,4-tetrazolyl-5-thio group, a 2-benzothiazolylthio group and the like.

Said alkyloxythiocarbonylthio group may include a dodecyloxythiocarbonylthio group and the like.

The group substituted through a nitrogen atom may include, for example, those represented by the formula:

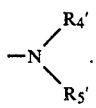

wherein, $R_4'$ and $R_5'$ each represent a hydrogen atom, an alkyl group, an aryl group, a heterocyclic group, a sulfamoyl group, a carbamoyl group, an acyl group, a sulfonyl group, an aryloxycarbonyl group or an alkoxycarbonyl group. $R_4'$ and $R_5'$ may be bonded to each other to form a hetero ring. However, $R_4'$ and $R_5'$ cannot both be hydrogen atoms.

Said alkyl group may be either straight or branched, having preferably 1 to 22 carbon atoms. Also, the alkyl group may have substituents such as an aryl group, an alkoxy group, an aryloxy group, an alkylthio group, an arylthio group, an alkylamino group, an arylamino group, an acylamino group, a sulfonamide group, an imino group, an acyl group, an alkylsulfonyl group, an arylsulfonyl group, a carbamoyl group, a sulfamoyl group, an alkoxycarbonyl group, an aryloxycarbonyl group, an alkyloxycarbonylamino group, an aryloxycarbonylamino group, a hydroxyl group, carboxyl group, a cyano group, halogen atoms, etc. Typical examples of said alkyl group may include an ethyl group, an octyl group, a 2-ethylhexyl group, a 2-chloroethyl group and the like.

The aryl group represented by $R_4'$ or $R_5'$ may preferably have 6 to 32 carbon atoms, particularly a phenyl group or a naphthyl group, which aryl group may also have substituents such as those as mentioned above as substituents on the alkyl group represented by $R_4'$ or $R_5'$ and alkyl groups. Typical examples of said aryl group may be, for example, a phenyl group, a 1-naphthyl group, a 4-methylsulfonylphenyl group and the like.

The heterocyclic group represented by $R_4'$ or $R_5'$ may preferably be a 5- or 6-membered ring, which may be a fused ring or have substituents. Typical examples may include a 2-furyl group, a 2-quinolyl group, a 2-pyrimidyl group, a 2-benzothiazolyl group, a 2-pyridyl group and the like.

The sulfamoyl group represented by $R_4'$ or $R_5'$ may include an N-alkylsulfamoyl group, an N,N-dialkylsulfamoyl group, an N-arylsulfamoyl group, an N,N-diarylsulfamoyl group and the like, and these alkyl and aryl groups may have substituents as mentioned above for the alkyl groups and aryl groups. Typical examples of the sulfamoyl group are, for example, an N,N-diethylsulfamoyl group, an N-methylsulfamoyl group, and N-dodecylsulfamoyl group, an N-p-tolylsulfamoyl group and the like.

The carbamoyl group represented by $R_4'$ or $R_5'$ may include an N-alkylcarbamoyl group, an N,N-dialkylcarbamoyl group, an N-arylcarbamoyl group, an N,N-diarylcarbamoyl group and the like, and these alkyl and aryl groups may have substituents as mentioned above for the alkyl groups and aryl groups. Typical examples of the carbamoyl group are an N,N-diethylcarbamoyl group, an N-methylcarbamoyl group, an N-dodecylcarbamoyl group, an N-p-cyanocarbamoyl group, an N-p-tolylcarbamoyl group and the like.

The acyl group represented by $R_4'$ or $R_5'$ may include an alkylcarbonyl group, an arylcarbonyl group, a heterocyclic carbonyl group, which alkyl group, aryl group and heterocyclic group may have substituents. Typical examples of the acyl group are a hexafluorobutanoyl group, a 2,3,4,5,6-pentafluorobenzoyl group, an acetyl group, a benzoyl group, naphthoyl group, a 2-furylcarbonyl group and the like.

The sulfonyl group represented by $R_4'$ or $R_5'$ may be, for example, an alkylsulfonyl group, an arylsulfonyl group or a heterocyclic sulfonyl group, which may also have substituents, including specifically an ethanesulfonyl group, a benzenesulfonyl group, an octanesulfonyl group, a naphthalenesulfonyl group, a p-chlorobenzenesulfonyl group and the like.

The aryloxycarbonyl group represented by $R_4'$ or $R_5'$ may have substituents as mentioned for the above aryl group, including specifically a phenoxycarbonyl group and the like.

The alkoxycarbonyl group represented by $R_4'$ or $R_5'$ may have substituents as mentioned for the above alkyl group, and specific examples are a methoxycarbonyl group, a dodecyloxycarbonyl group, a benzyloxycarbonyl group and the like.

The heterocyclic ring formed by bonding between $R_4'$ and $R_5'$ may preferably be a 5- or 6-membered ring, which may be which either saturated or unsaturated, either has aromaticity or not, or may also be a fused ring. Said heterocyclic ring may include, for example, an N-phthalimide group, an N-succinimide group, a 4-N-urazolyl group, a 1-N-hydantoinyl group, a 3-N-2,4-dioxooxazolidinyl group, a 2-N-1,1-dioxo-3-(2H)-oxo-1,2-benzthiazolyl group, a 1-pyrrolyl group, a 1-pyrrolidinyl group, a 1-pyrazolyl group, a 1-pyrazolidinyl group, a 1-piperidinyl group, a 1-pyrrolinyl group, a 1-imidazolyl group, a 1-imidazolinyl group, a 1-indolyl group, a 1-isoindolinyl group, a 2-isoindolyl group, a 2-isoindolinyl group, a 1-benzotriazolyl group, a 1-benzoimidazolyl group, a 1-(1,2,4-triazolyl) group, a 1-(1,2,3-triazolyl) group, a 1-(1,2,3,4-tetrazolyl) group, an N-morpholinyl group, a 1,2,3,4-tetrahydroquinolyl group, a 2-oxo-1-pyrrolidinyl group, a 2-1H-pyrridone group, a phthaladione group, a 2-oxo-1-piperidinyl group, etc. These heterocyclic groups may be substituted by an alkyl group, an aryl group, an alkyloxy group, an aryloxy group, an acyl group, a sulfonyl group, an alkylamino group, an arylamino group, an acylamino group, a sulfonamino group, a carbamoyl group, a sulfamoyl group, an alkylthio group, an arylthio group, an ureido group, an alkoxycarbonyl group, an aryloxycarbonyl group, an imide group, a nitro group, a cyano group, a carboxyl group or halogen atoms.

The nitrogen-containing heterocyclic ring represented by Z and Z' may include a pyrazole ring, an imidazole ring, a triazole ring or a tetrazole ring, and the substituents which may be possessed by the above rings may include those as mentioned for the above R. When the substituent (e.g. R, $R_1$ to $R_8$) on the heterocyclic ring in the formula (I) and the formulae (II) to (VII) as hereinafter described has a moiety of the formula:

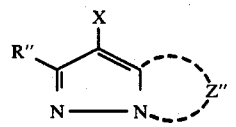

(wherein R'', X and Z'' have the same meanings as R, X and Z in the formula (I)), the so-called bis-form type coupler is formed, which is of course included in the present invention. The ring formed by Z, Z', Z'' and $Z_1$ as hereinafter described may also be fused with another ring (e.g. a 5- to 7-membered cycloalkene). For example, $R_5$ and $R_6$ in the formula [V], $R_7$ and $R_8$ in the formula (VI) may be bonded to each other to form a ring (e.g. a 5- to 7-membered ring).

The compounds represented by the formula (I) can be also represented specifically by the following formulae (II) through (VII).

(II)

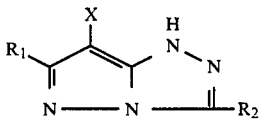

(III)

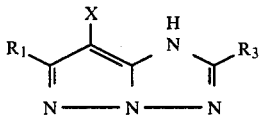

(IV)

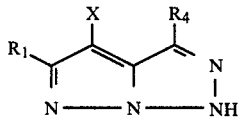

(V)

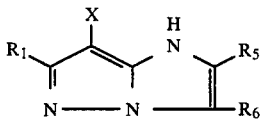

(VI)

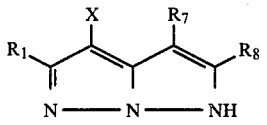

(VII)

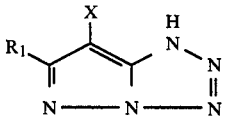

In the above formulae (II) to (VII), $R_1$ to $R_8$ and X have the same meanings as the above R and X.

Of the compounds represented by the formula (I), those represented by the following formula (VIII) are preferred.

(VIII)

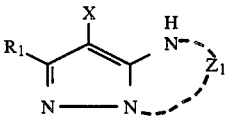

wherein $R_1$, X and $Z_1$ have the same meanings as R, X and Z in the formula (I).

Of the magenta couplers represented by the formulae (II) to (VII), the magenta coupler represented by the formula (II) is particularly preferred.

To describe about the substituents on the heterocyclic ring in the formulae (I) to (VIII), R in the formula (I) and $R_1$ in the formulae (II) to (VIII) should preferably satisfy the following condition 1, more preferably satisfy the following conditions 1 and 2, and particularly preferably satisfy the following conditions 1, 2 and 3:

Condition 1: the root atom directly bonded to the heterocyclic ring is a carbon atom, Condition 2: only one hydrogen atom is bonded to said carbon atom or no hydrogen atom is bonded to it, and Condition 3: the bondings between the root atom and adjacent atoms are all single bonds.

Of the substituents R and $R_1$ on the above heterocyclic ring, most preferred are those represented by the formula (IX) shown below:

(IX)

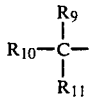

In the above formula, each of $R_9$, $R_{10}$ and $R_{11}$ represent a hydrogen atom, a halogen atom, an alkyl group, a cycloalkyl group, an alkenyl group, a cycloalkenyl group, an alkynyl group, an aryl group, a heterocyclic group, an acyl group, a sulfonyl group, a sulfinyl group, a phosphonyl group, a carbamoyl group, a sulfamoyl group, a cyano group, a spiro compound residual group, a bridged hydrocarbon compound residual group, an alkoxy group, an aryloxy group, a heterocyclicoxy group, a siloxy group, an acyloxy group, a carbamoyloxy group, an amino group, an acylamino group, a sulfonamide group, an imide group, an ureido group, a sulfamoylamino group, an alkoxycarbonylamino group, an aryloxycarbonylamino group, an alkoxycarbonyl group, an aryloxycarbonyl group, an alkylthio group, an arylthio group or a heterocyclicthio group.

Also, at least two of said $R_9$, $R_{10}$ and $R_{11}$, for example, $R_9$ and $R_{10}$ may be bonded together to form a saturated or unsaturated ring (e.g. cycloalkane ring, cycloalkene ring or heterocyclic ring), and further to form a bridged hydrocarbon compound residual group by bonding $R_{11}$ to said ring.

The groups represented by $R_9$ to $R_{11}$ may have substituents, and examples of the groups represented by $R_9$ to $R_{11}$ and the substituents which may be possessed by said groups may include examples of the substituents which may be possessed by the R in the above formula (I), and substituents which may be possessed by said substituents.

Also, examples of the ring formed by bonding between $R_9$ and $R_{10}$, the bridged hydrocarbon compound residual group formed by $R_9$ to $R_{11}$ and the substituents which may be possessed thereby may include examples of cycloalkyl, cycloalkenyl and heterocyclic groups as mentioned for substituents on the R in the aforesaid formula (I) and substituents thereof.

Of the compounds of the formula (IX), preferred are:

(i) the case where two of $R_9$ to $R_{11}$ are alkyl groups; and (ii) the case where one of $R_9$ to $R_{11}$, for example, $R_{11}$ is a hydrocarbon atom and two of the other $R_9$ and $R_{10}$ are bonded together with the root carbon atom to form a cycloalkyl group.

Further, preferred in (i) is the case where two of $R_9$ to $R_{11}$ are alkyl groups and the other one is a hydrogen atom or an alkyl group.

Here, said alkyl and said cycloalkyl may further have substituents, and examples of said alkyl, said cycloalkyl and substituents thereof may include those of alkyl, cycloalkyl and substituents thereof as mentioned for the substituents on the R in the formula (I) and the substituents thereof.

In the following, examples of the magenta coupler of the present invention are enumerated, but are not to be taken as limitative of the present invention.

1
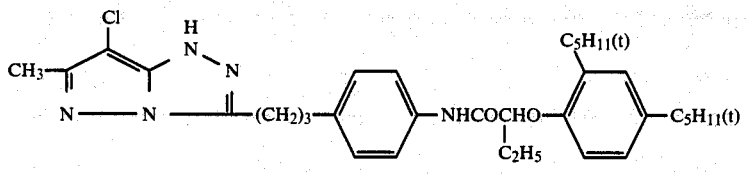
2
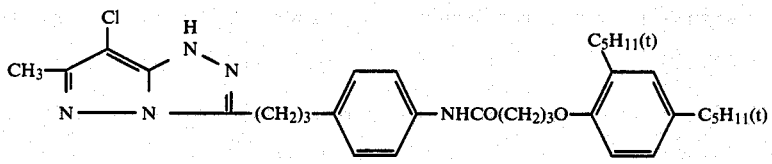
3
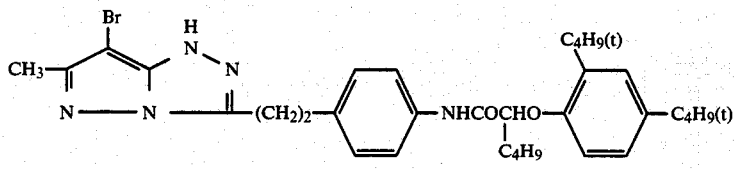
4
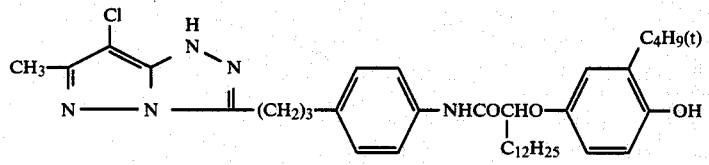
5
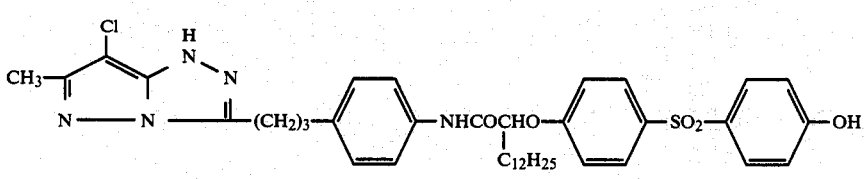
6
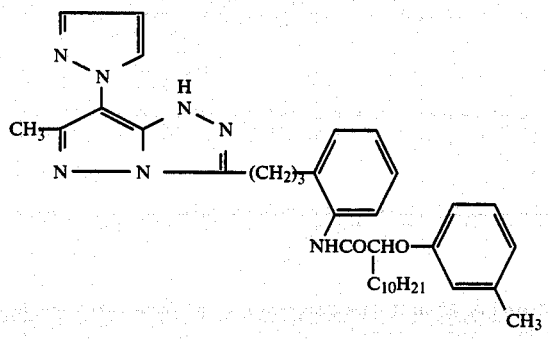
7
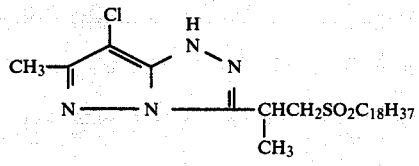
8
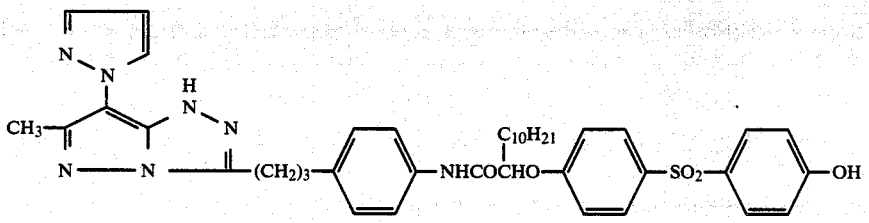
9
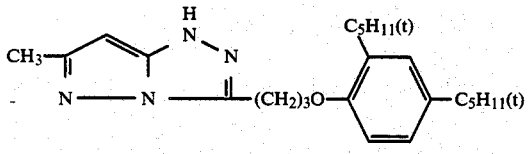
10
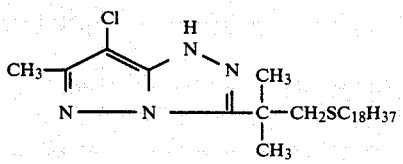

-continued
11
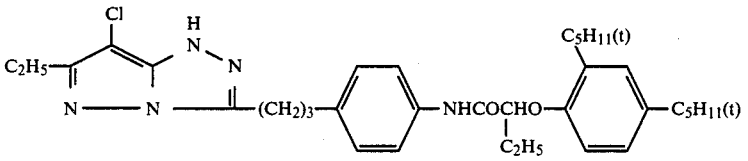
12
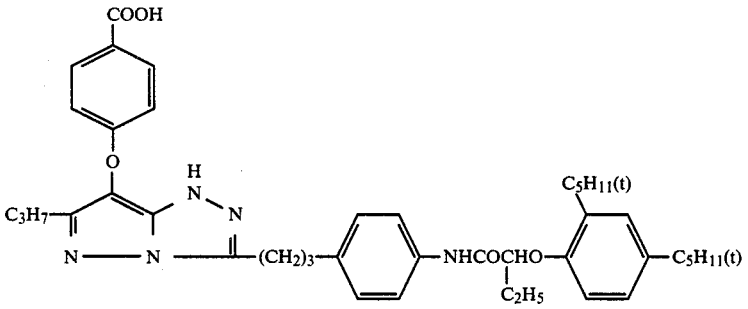
13
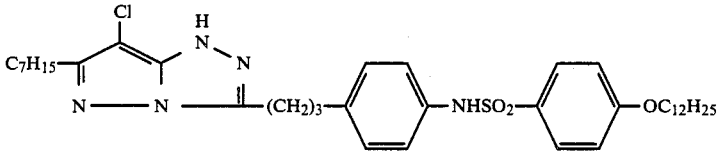
14
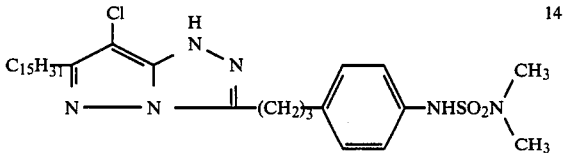
15
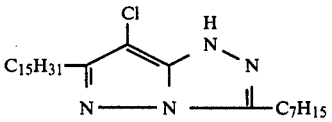
16
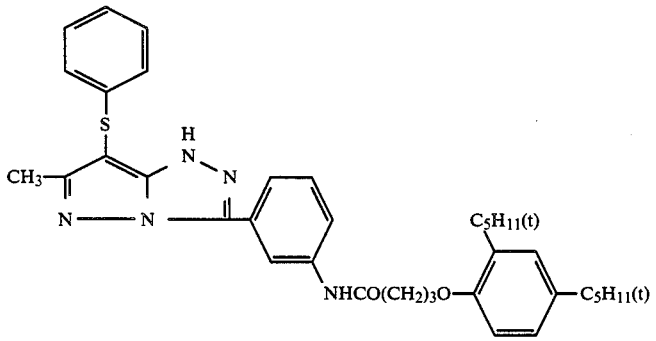
17
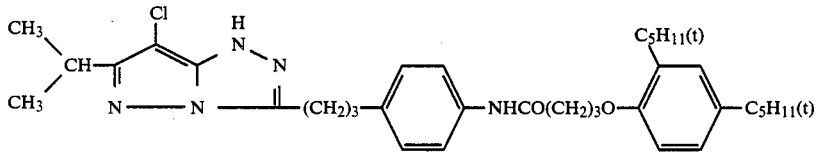
18
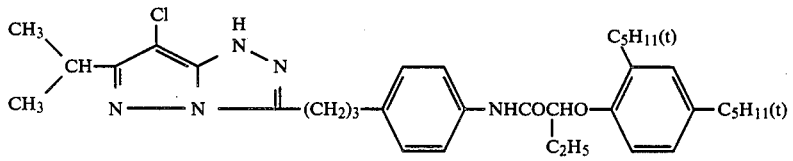
19
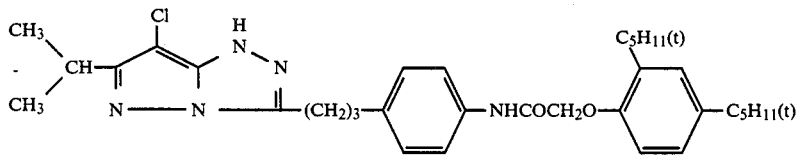

-continued
20
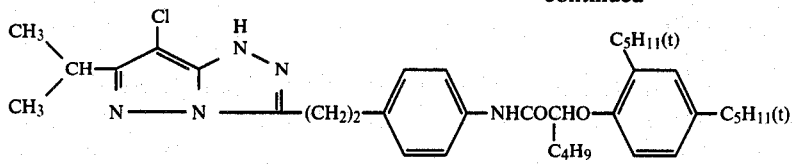
21
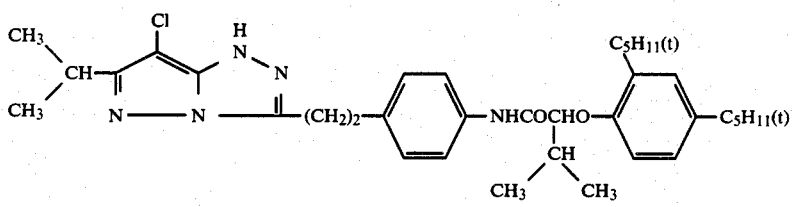
22
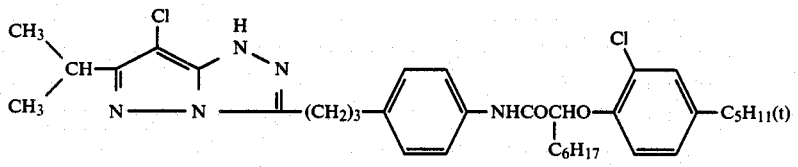
23
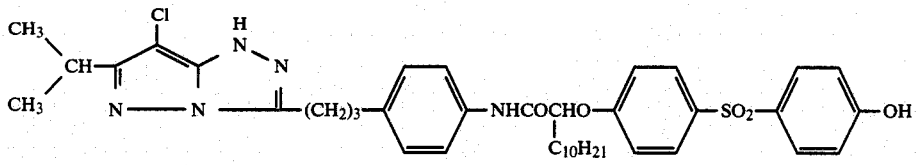
24
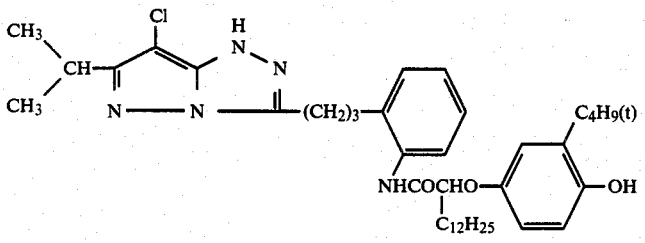
25
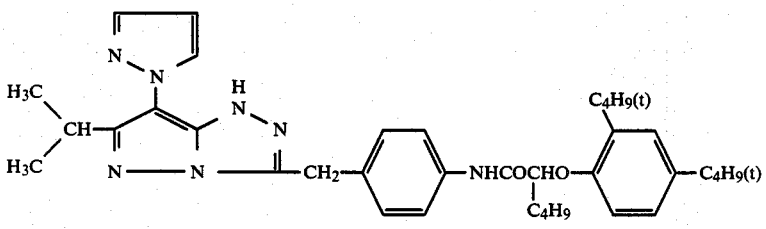
26
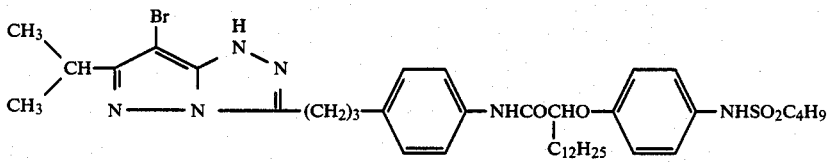
27
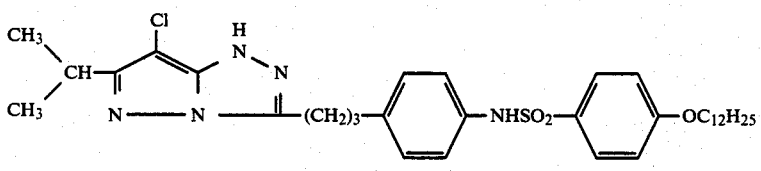
28
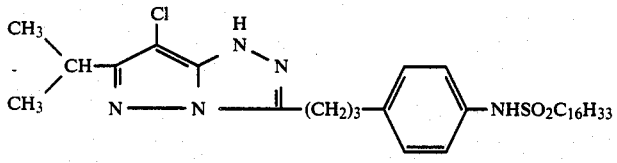

-continued
29
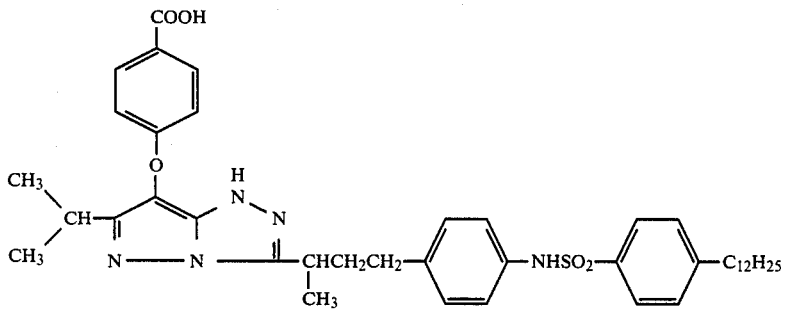
30
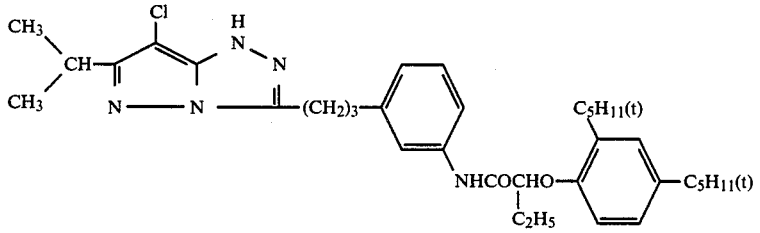
31
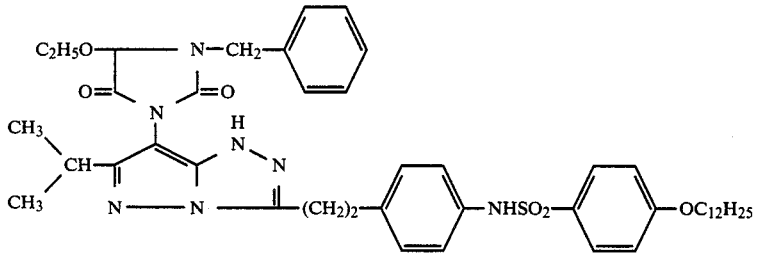
32
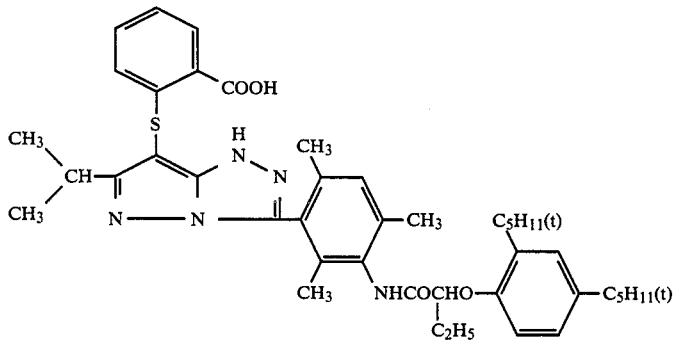
33
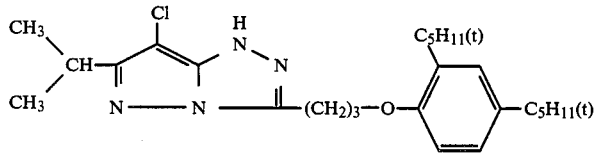
34
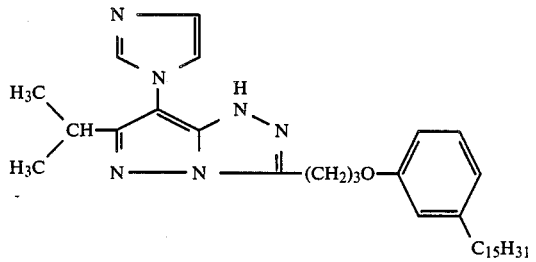
35
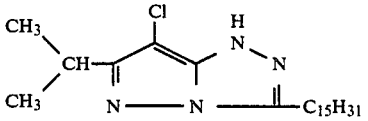

-continued
36
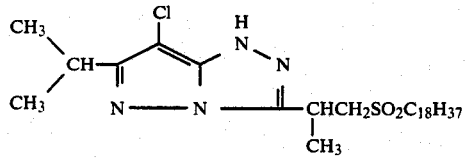
37
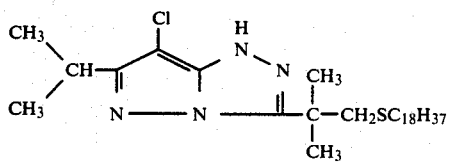
38
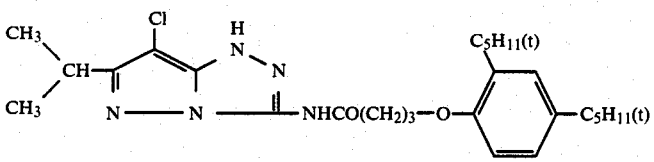
39
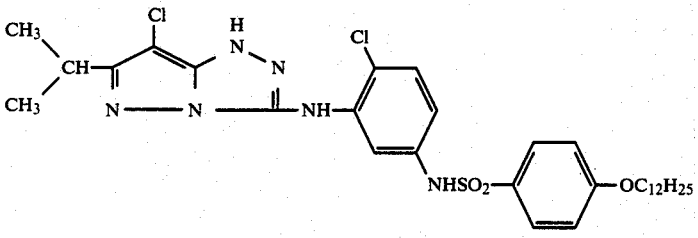
40
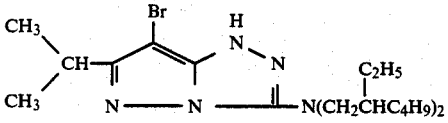
41
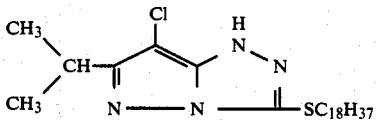
42
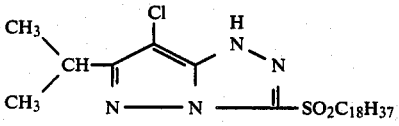
43
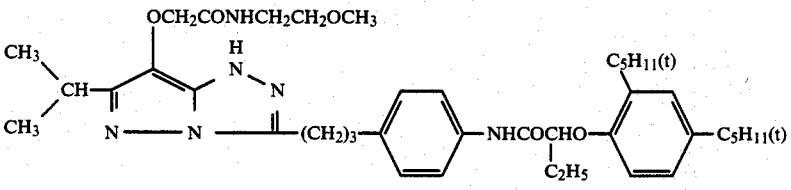
44
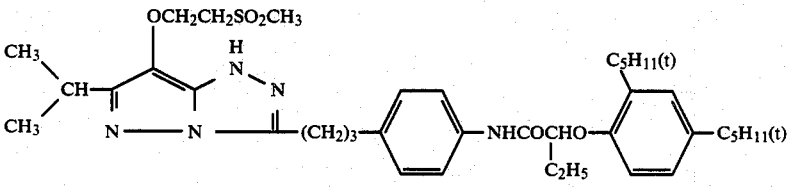
45
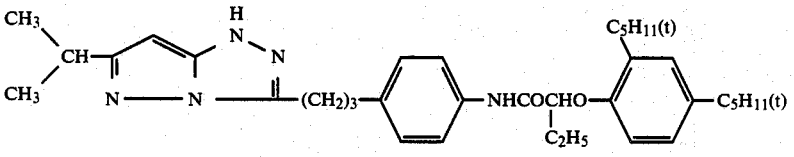
46
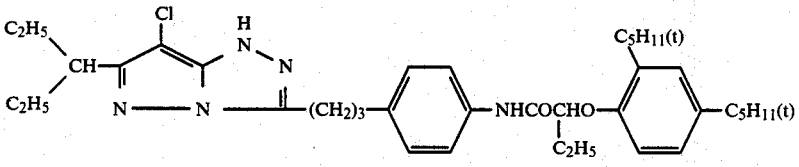

-continued
47
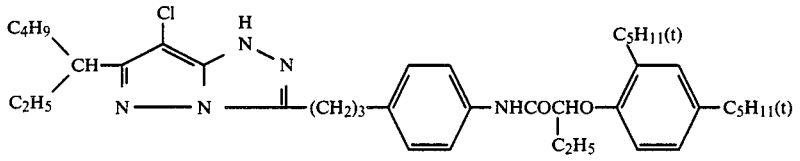
48
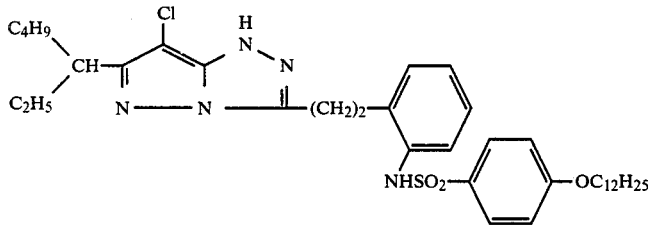
49
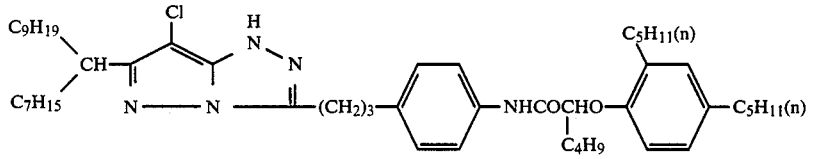
50
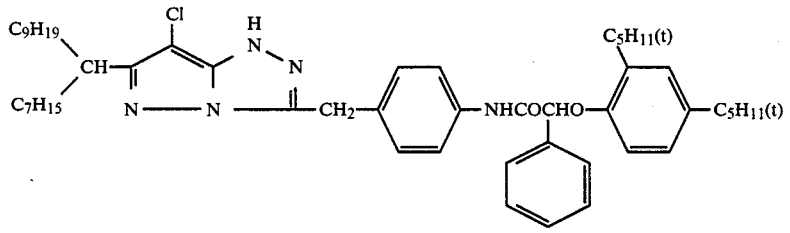
51
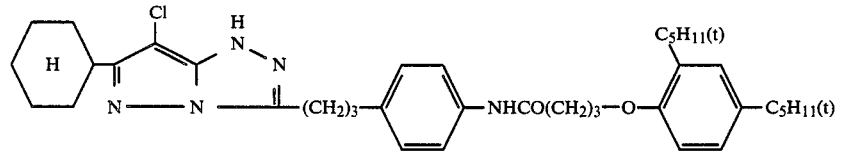
52
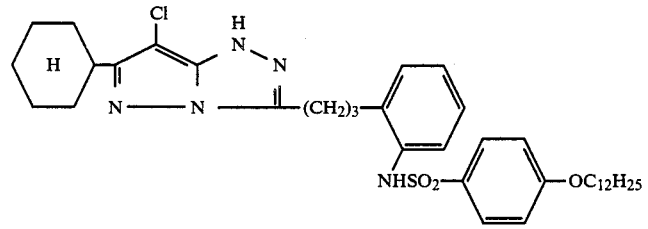
53
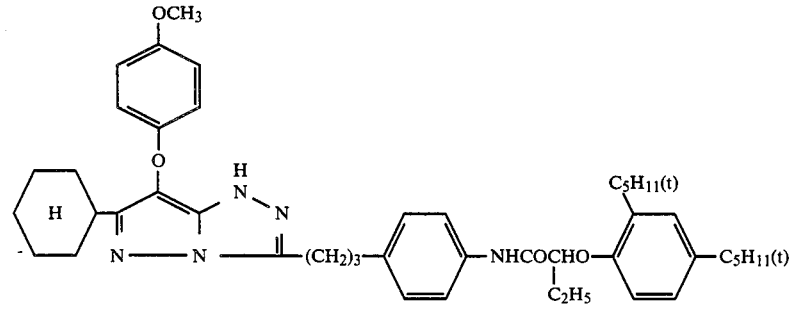

-continued
54
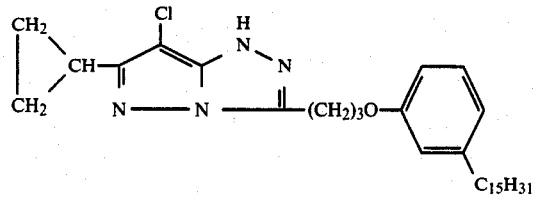
55
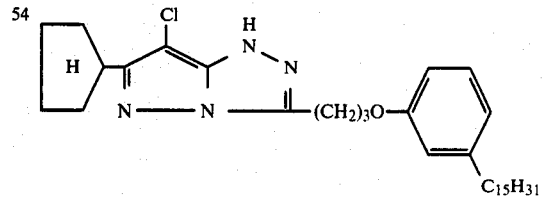
56
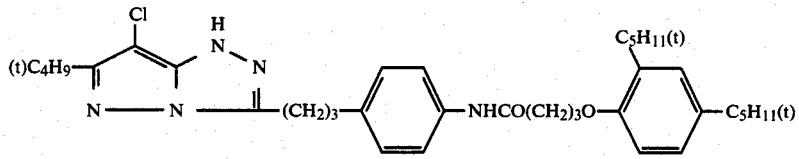
57
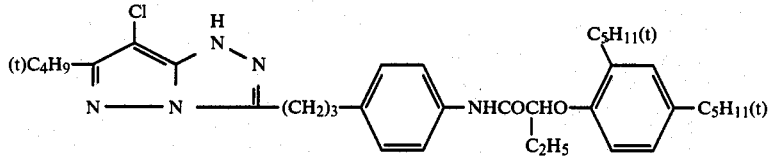
58
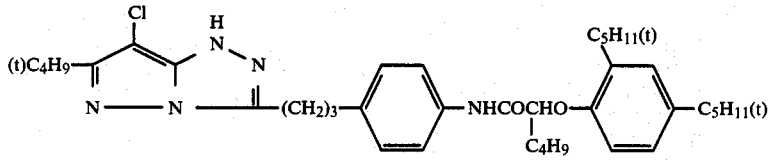
59
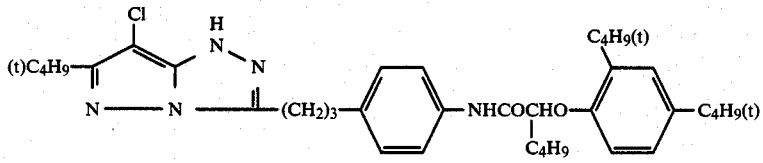
60
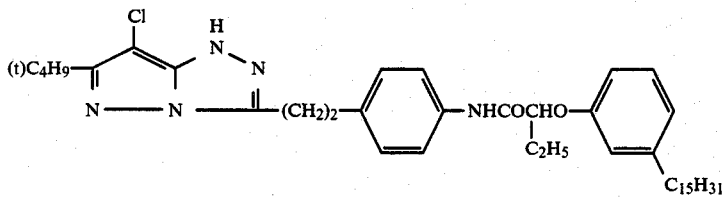
61
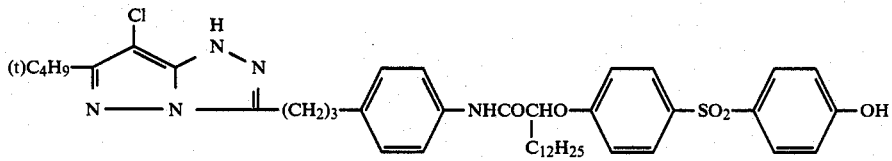
62
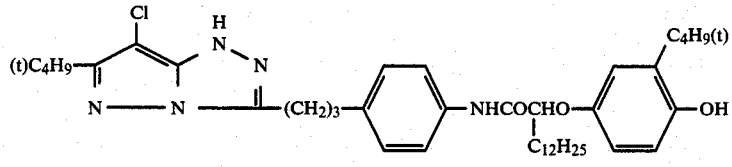
63
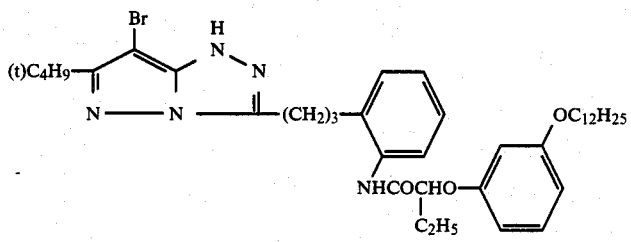

-continued
64
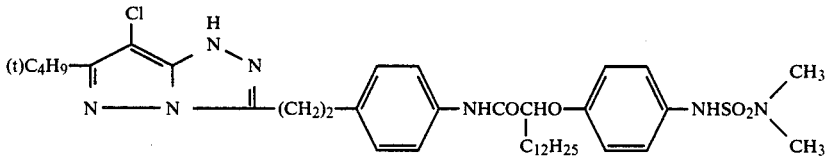
65
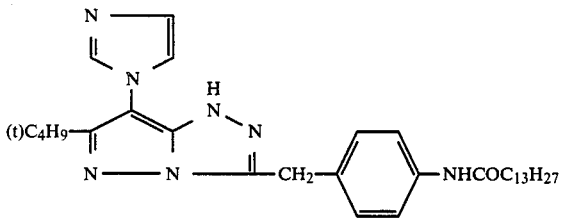
66
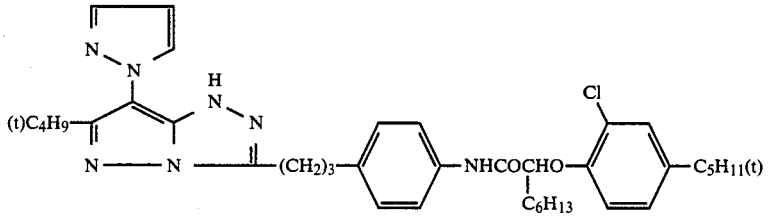
67
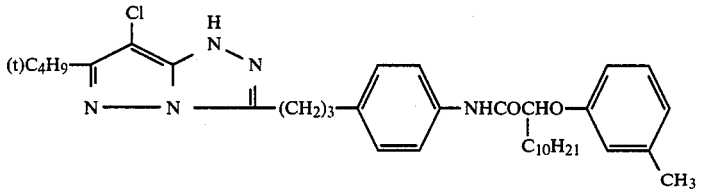
68
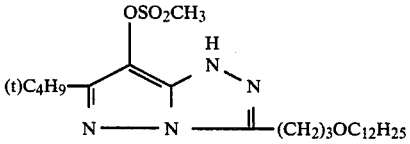
69
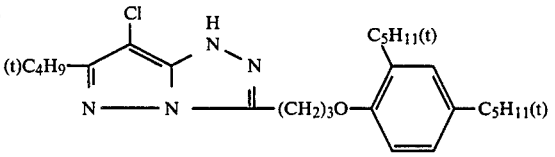
70
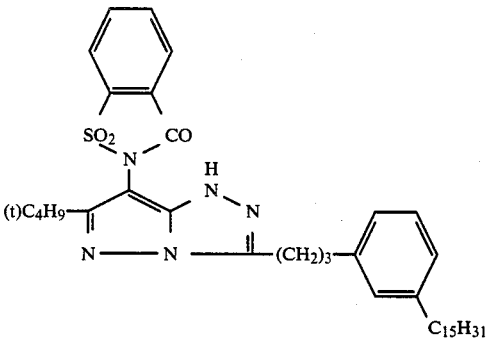
71
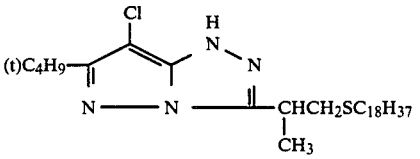
72
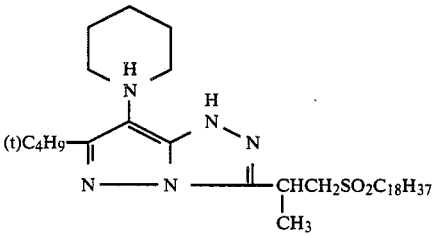
73
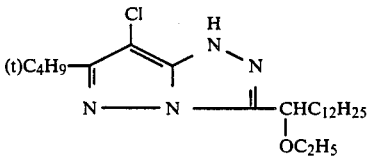

-continued
74
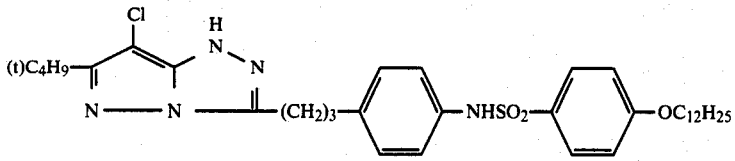
75
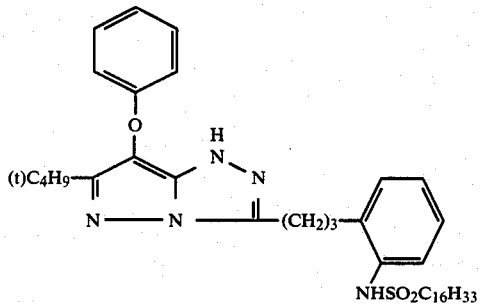
76
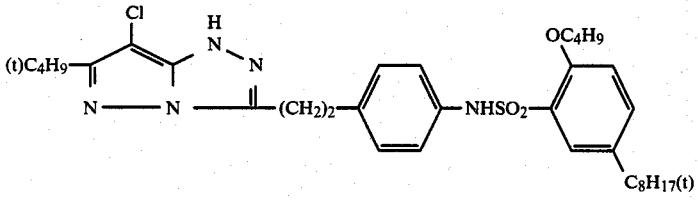
77
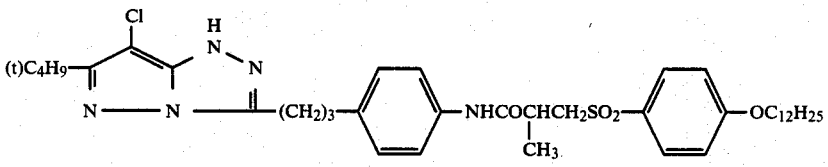
78
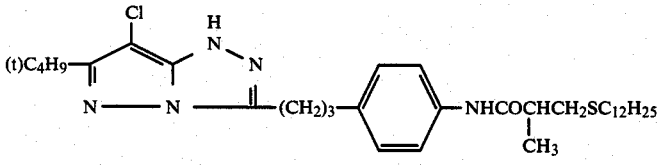
79
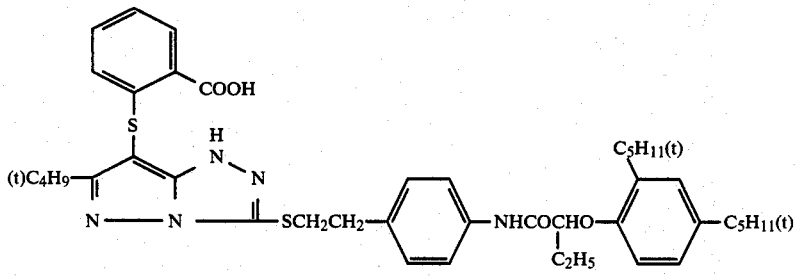
80
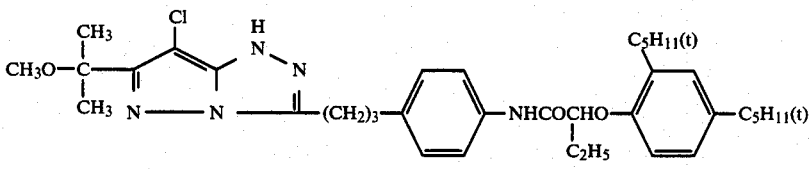
81
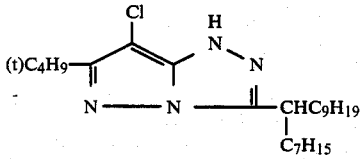

-continued
82
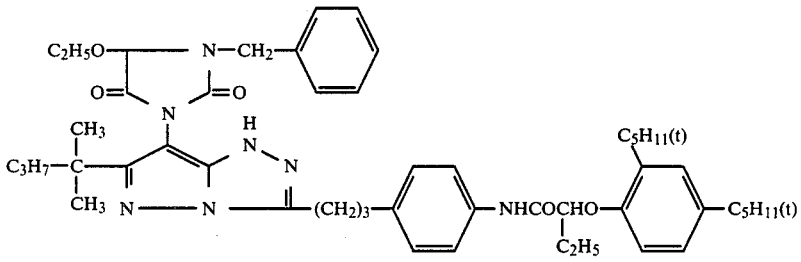
83
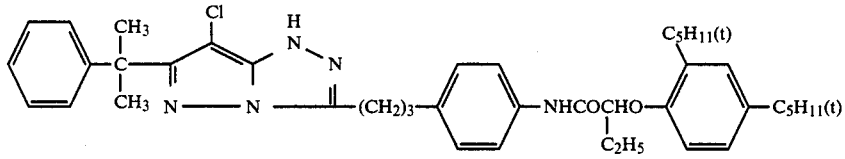
84
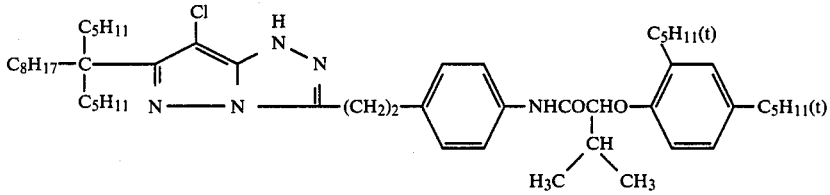
85
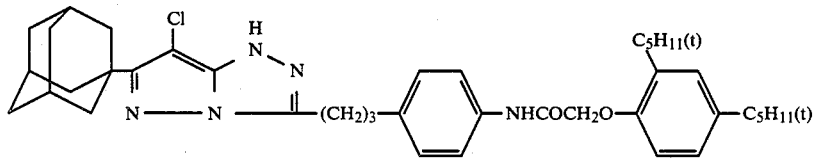
86
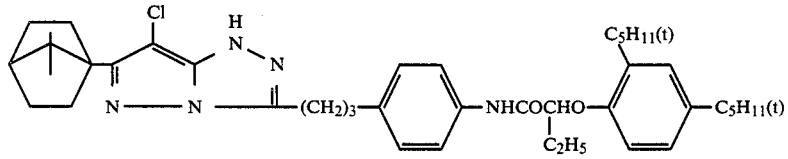
87
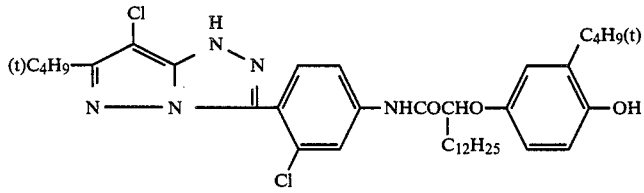
88
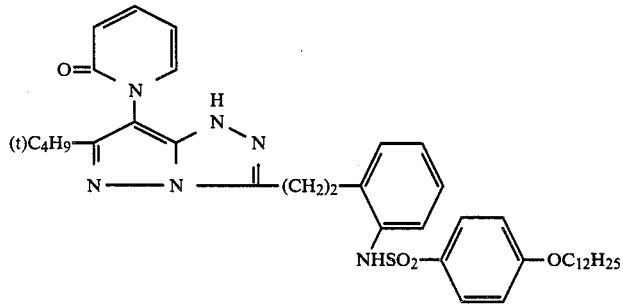
89
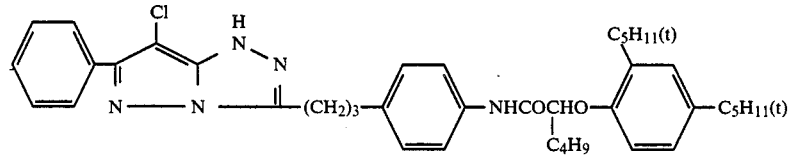

-continued
90
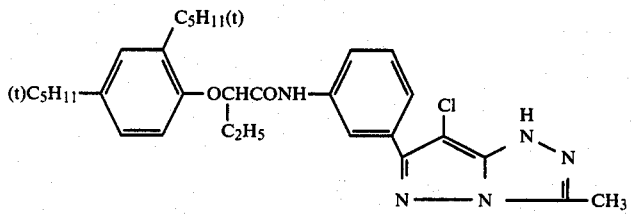
91
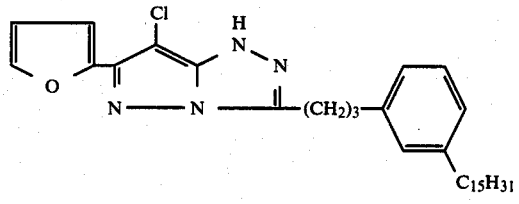
92
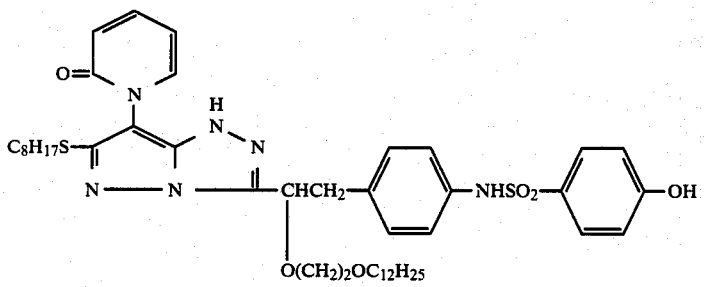
93
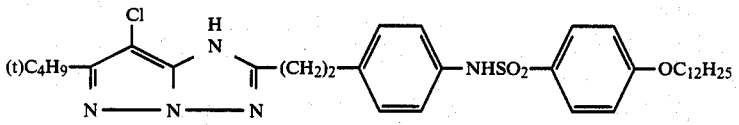
94
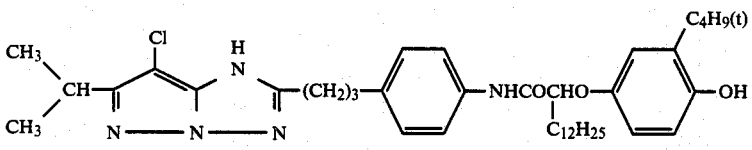
95
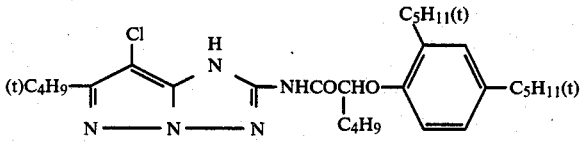
96
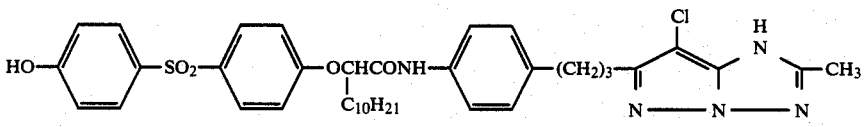
97
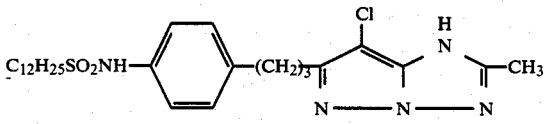
98
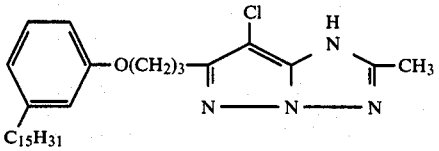

-continued
99
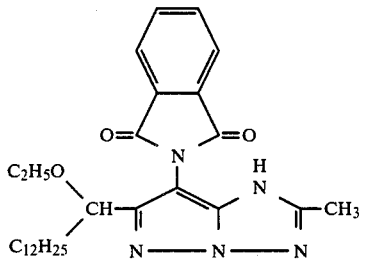
100
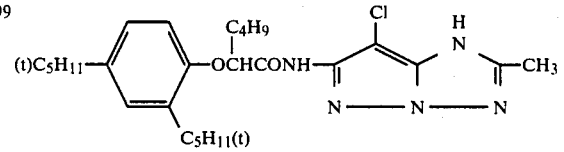
101
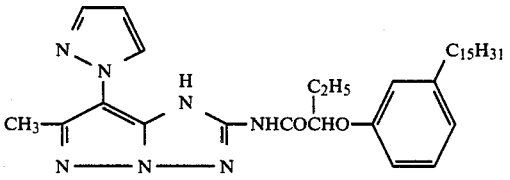
102
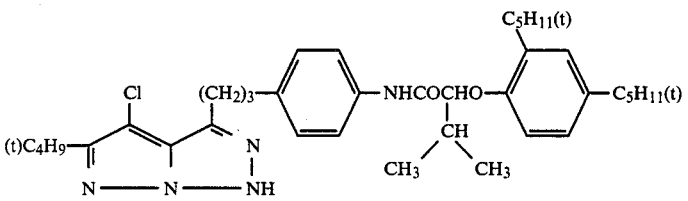
103
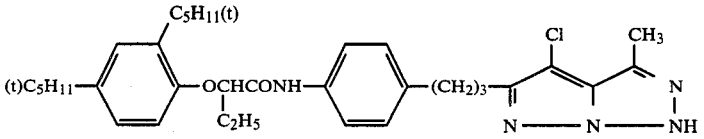
104
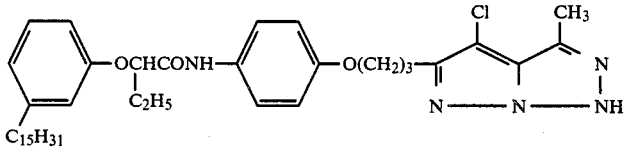
105
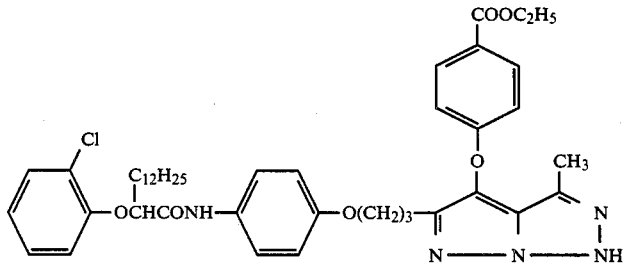
106
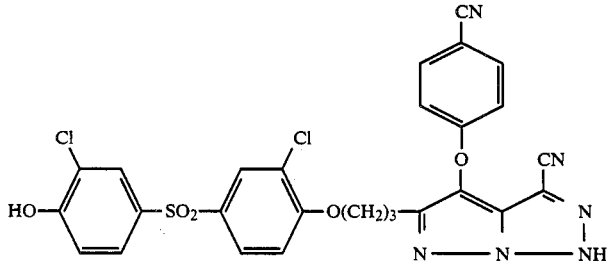

-continued
107
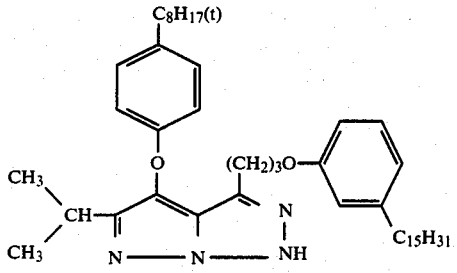
108
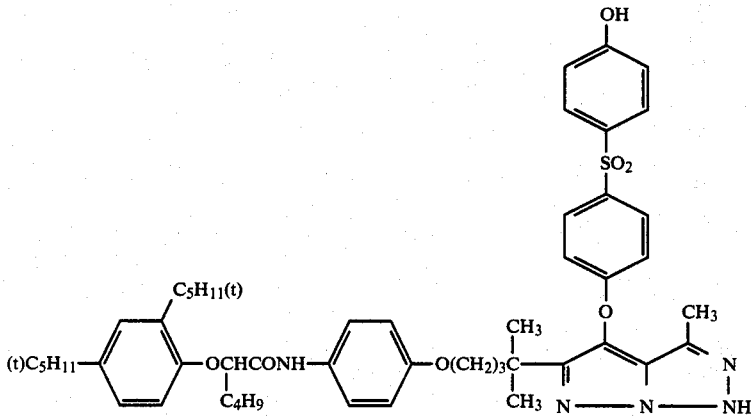
109
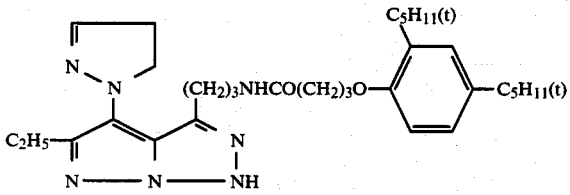
110
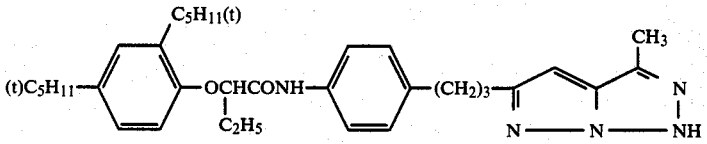
111
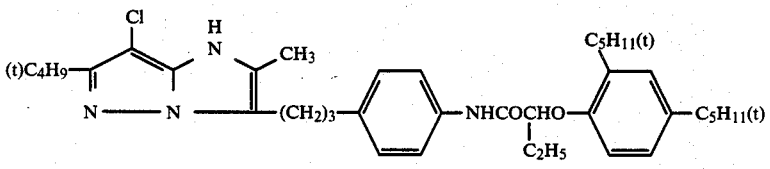
112
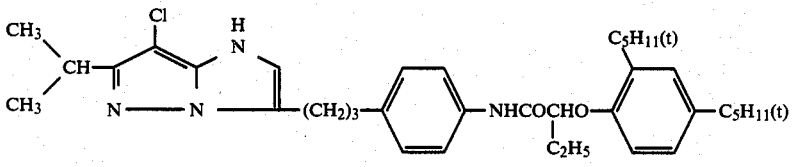
113
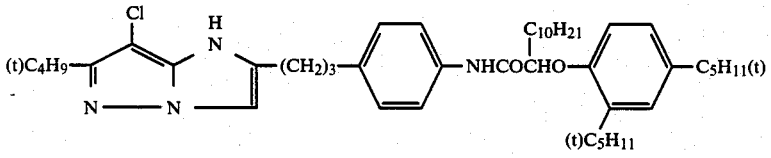

-continued
114
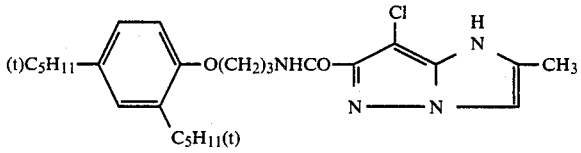
115
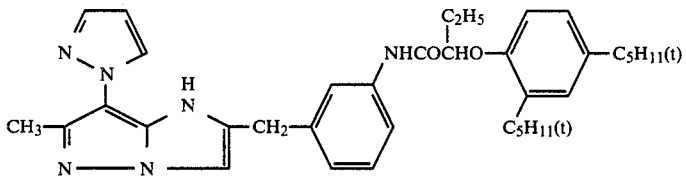
116
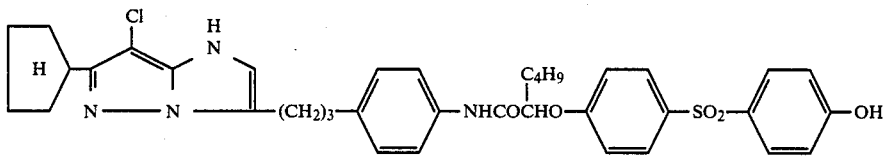
117
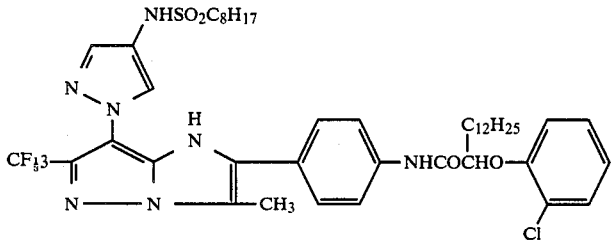
118
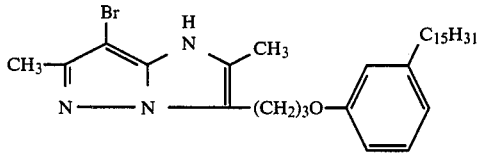
119
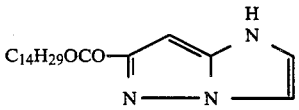
120
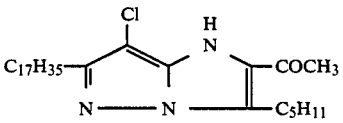
121
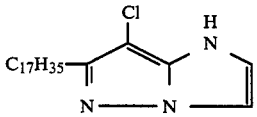
122
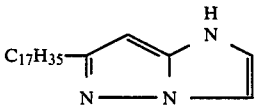
123
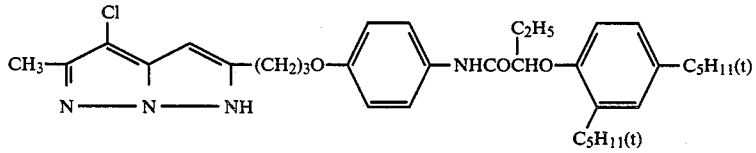
124
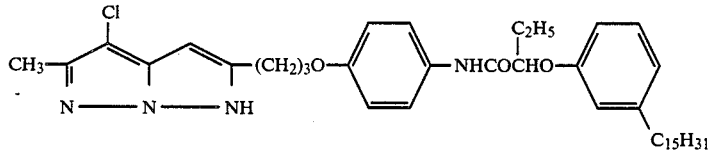

-continued
125
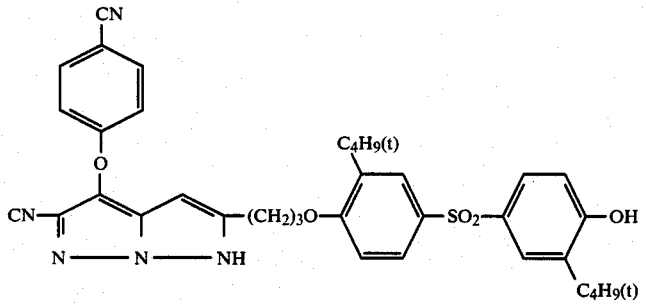
126
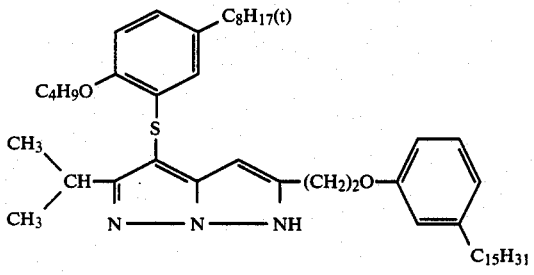
127
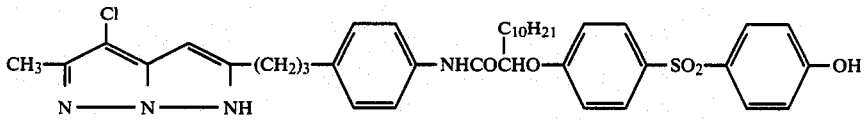
128
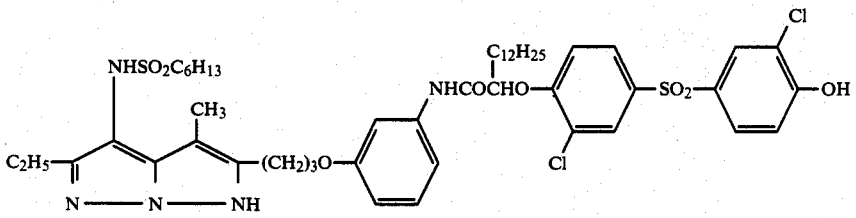
129
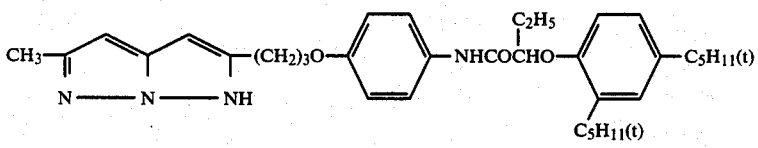
130
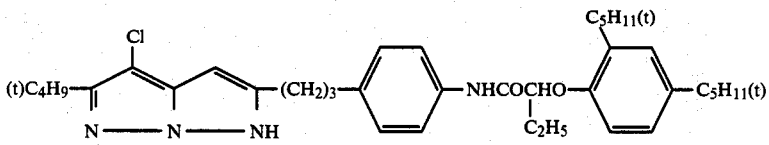
131
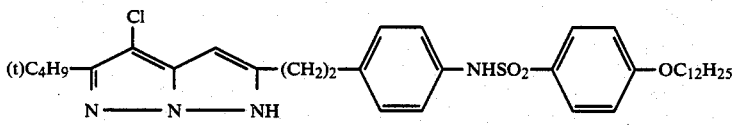
132
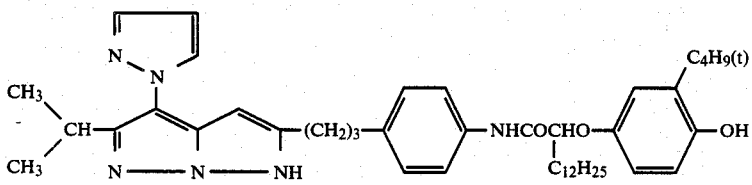

-continued
133
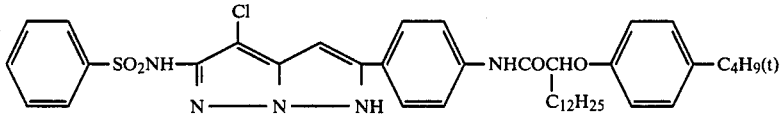
134
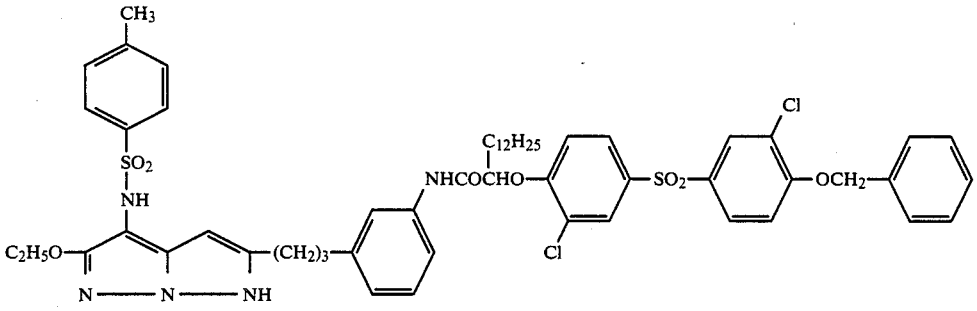
135
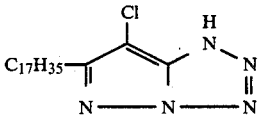
136
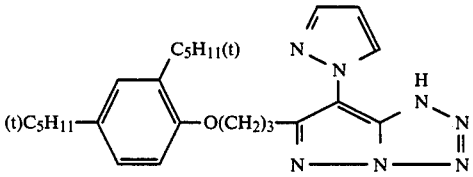
137
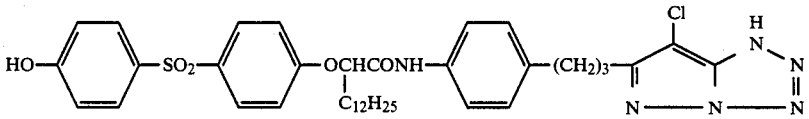
138
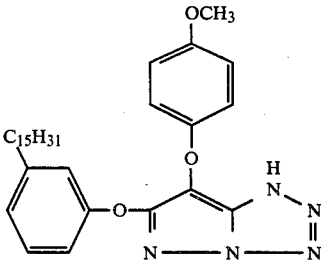
139
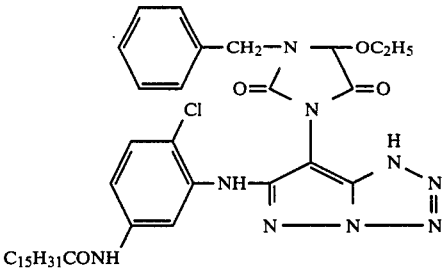
140
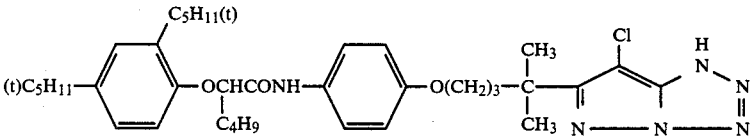
141
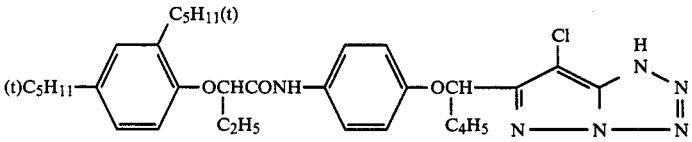
142
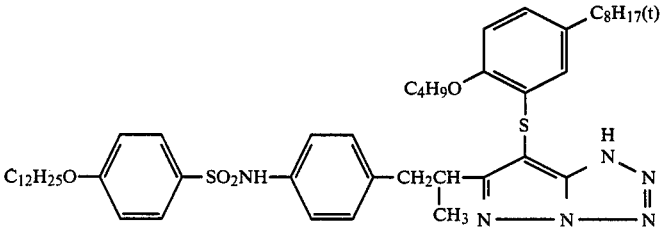

-continued

143

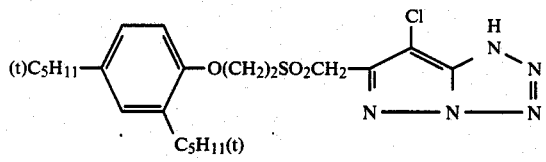

The above couplers were synthesized by referring to the Journal of the Chemical Society, Perkin I (1977), pp. 2047–2052, U.S. Pat. No. 3,725,067, Japanese Provisional Patent Publications No. 99437/1984 and No. 42045/1984.

The coupler of the present invention can be used in an amount generally within the range of from $1\times10^{-3}$ mole to $5\times10^{-1}$ mole, preferably from $1\times10^{-2}$ to $5\times10^{-1}$ mole, per mole of the silver halide.

The coupler of the present invention can be used in combination with other kinds of magenta couplers.

When the light-sensitive silver halide photographic material is used as a multi-color light-sensitive photographic material, a yellow coupler and a cyan coupler conventionally used in this field of the art can be used in a conventional manner. Also, a colored coupler having the effect of color correction or a coupler which releases a developing inhibitor with development (DIR coupler) may be used, if necessary. The above coupler can be used as a combination of two or more different kinds in the same layer or the same coupler may be added into the two or more layers, in order to satisfy the characteristics demanded for the light-sensitive material.

As the cyan coupler and the yellow coupler to be used in the present invention, there may be employed phenol type or naphthol type cyan couplers and acylacetamide type or benzoylmethane type yellow couplers, respectively.

These yellow couplers are described in, for example, U.S. Pat. Nos. 2,778,658, No. 2,875,057, No. 2,908,573, No. 3,227,155, No. 3,227,550, No. 3,253,924, No. 3,265,506, No. 3,277,155, No. 3,341,331, No. 3,369,895, No. 3,384,657, No. 3,408,194, No. 3,415,652, No. 3,447,928, No. 3,551,155, No. 3,582,322, No. 3,725,072, No. 3,894,875; West German Offenlegunsschrift No. 15 47 868, No. 20 57 941, No. 21 62 899, No. 21 63 812, No. 22 18 461, No. 22 19 917, No. 22 61 361 and No. 22 63 875; Japanese Patent Publication No. 13576/1974; Japanese Provisional Patent Publications No. 29432/1973, No. 66834/1973, No. 10736/1974, No. 122335/1974, No. 28834/1975 and No. 132926/1975.

The cyan couplers are described in, for example, U.S. Pat. Nos. 2,369,929, No. 2,423,730, No. 2,434,272, No. 2,474,293, No. 2,698,794, No. 2,706,684, No. 2,772,162, No. 2,801,171, No. 2,895,826, No. 2,908,573, No. 3,034,892, No. 3,046,129, No. 3,227,550, No. 3,253,294, No. 3,311,476, No. 3,386,301, No. 3,419,390, No. 3,458,315, No. 3,476,563, No. 3,516,831, No. 3,560,212, No. 3,582,322, No. 3,583,971, No. 3,591,383, No. 3,619,196, No. 3,632,347, No. 3,652,286, No. 3,737,326, No. 3,758,308, No. 3,779,763, No. 3,839,044 and No. 3,880,661; West German Offenlegunsschrift No. 21 63 811 and No. 22 07 468; Japanese Patent Publications No. 27563/1964 and No. 28836/1970; Japanese Provisional Patent Publications No. 37425/1972, No. 10135/1975, No. 25228/1975, No. 112038/1975, No. 117422/1975, No. 130441/1975, No. 109630/1978, No. 65134/1981 and No. 99341/1981; and Research Disclosure No. 14,853 (1976), etc.

In the present invention, the metal complex represented by the above formulae (XI), (XII) and (XIII) (hereinafter referred to comprehensively as the metal complex according to the present invention) may be used either singly, as a combination of two or more compounds represented by each formula or as a combination of one or more compounds represented by the respective formulae. In any case, the object of the present invention can be fully accomplished.

$X^1$ and $X^2$ in the formulae (XI), (XII) and (XIII) may be either identical or different from each other, each representing an oxygen atom, a sulfur atom or —$NR^5$— {$R^5$ is a hydrogen atom, an alkyl group (e.g. a methyl group, an ethyl group, an n-propyl group, an i-propyl group, an n-butyl group, a t-butyl group, an i-butyl group, a benzyl group, etc.), an aryl group (e.g. a phenyl group, a tolyl group, a naphthyl group, etc.) or a hydroxyl group}, preferably an oxygen atom or a sulfur atom, more preferably an oxygen atom.

$X^3$ in the formula (XIII) represents a hydroxyl group or a mercapto group, preferably a hydroxyl group.

Y in the formulae (XI), (XII) and (XIII) represents (there are two Ys in the formula (XIII), and they may be either identical or different) an oxygen atom or a sulfur atom, preferably a sulfur atom.

In the formulae (XI), (XII) and (XIII), $R^1$, $R^2$, $R^3$ and $R^4$ may be the same or different from each other and each represent a hydrogen atom, a halogen atom (fluorine atom, chlorine atom, bromine atom, iodine atom), a cyano group, an alkyl group (for example, a methyl group, an ethyl group, a propyl group, a butyl group, a hexyl group, an octyl group, a dodecyl group, a hexadecyl group, etc., and these alkyl groups may be a straight chain alkyl group or a branched alkyl group), an aryl group (for example, a phenyl group, a naphthyl group, etc.), a cycloalkyl group (for example, a cyclopentyl group, a cyclohexyl group) or a heterocyclic group (for example, a pyridyl group, an imidazolyl group, a furyl group, a thienyl group, a pyrrolyl group, a pyrrolidinyl group, a quinolyl group, a morpholinyl group, etc.) each of which groups is bonded to a carbon atom directly or through a divalent linking group [for example, —O—, —S—, —NH—, —$NR^{5'}$—, {$R^{5'}$ represents a monovalent group such as a hydroxyl group, an alkyl group (for example, a methyl group, an ethyl group, an n-propyl group, an i-propyl group, an n-butyl group, a t-butyl group, an i-butyl group, etc.), an aryl group (for example, a phenyl group, a tolyl group, a naphthyl group, etc.), etc.}, —OCO—, —CO—, —NHCO—, —CONH—, —COO—, —$SO_2$NH—, —NH$SO_2$—, —$SO_2$—, etc.]. Of these substituents, examples of groups formed by the alkyl group, the aryl group, the cycloalkyl group or the heterocyclic group, which is bonded to the carbon atom through a divalent linking group, which divalent linking group may include, for example, an alkoxy group (for example, a straight or branched alkyloxy group such as a methoxy group, an ethoxy group, an n-butyloxy group, an octyloxy group, etc.), an alkoxycarbonyl group (for example, a straight or branched alkyloxycarbonyl group such as a methoxycarbonyl group, an ethoxycarbonyl group, an n-hexanedecyloxycarbonyl group, etc.), an alkylcarbonyl group (for example, a straight or branched alkylcarbonyl group such as an acetyl group, a valeryl group, a stearoyl group, etc.), an arylcarbonyl group (for example, a benzoyl group, etc.), an alkylamino group (for example, a straight or branched alkylamino group such as an N-n-butyramino group, an N,N-di-n-butyramino group, an N,N-di-n-octylamino group, etc.), an alkylcarbamoyl group (for example, a straight or branched alkylcarbamoyl group such as a n-butylcarbamoyl group, an dodecylcarbamoyl group, etc.), an alkylsulfamoyl group (for example, a straight or branched alkylsulfamoyl group such as an n-butylsulfamoyl group, an n-dodecylsulfamoyl group, etc.), an alkylacylamino group (for example, a straight or branched alkylcarbonylamino group such as an acetylamino group, a palmitoylamino group, etc.), an aryloxy group (for example, a phenoxy group, a naphthoxy group, etc.), an aryloxycarbonyl group (for example, a phenoxycarbonyl group, a naphthoxycarbonyl group, etc.), an arylamino group (for example, an N-phenylamino group, an N-phenyl-N-methylamino group, etc.), an arylcarbamoyl group (for example, a phenylcarbamoyl group, etc.), an arylsulfamoyl group (for example, a phenylsulfamoyl group, etc.) and an arylacylamino group (for example, a benzoylamino group), etc.

$R^1$, $R^2$, $R^3$ and $R^4$ in the formulae (XI), (XII) and (XIII) may be formed a 5- or 6-membered ring by combining with each other at least one of combinations of $R^1$ and $R^2$, and $R^3$ and $R^4$ with the carbon atoms to be bonded thereto. In this case, examples of the 5- or 6-membered ring formed by combining with each other at least one combining of $R^1$ and $R^2$, and $R^3$ and $R^4$ with the carbon atom to be bonded thereto may include, for example, a hydrocarbon ring containing at least one of unsaturated bond such as a cyclopentene ring, a cyclohexene ring, a benzene ring (provided that the benzene ring includes a condensed benzene ring, i.e., such as a naphthalene ring, an anthracene ring, etc.), a heterocyclic ring (for example, nitrogen-containing 5- or 6-membered heterocyclic ring), etc. In the cases where these 5- or 6-membered rings have substituents, examples of the substituents may include, for example, halogen atoms (fluorine, chlorine, bromine, iodine), a cyano group, an alkyl group (for example, a straight or branched alkyl group having 1 to 20 carbon atoms such as a methyl group, an ethyl group, an n-propyl group, an n-butyl group, an n-octyl group, a t-octyl group, an n-hexadecyl group, etc.), an aryl group (for example, a phenyl group, a naphthyl group, etc.), an alkoxy group (for example, a straight or branched alkyloxy group such as a methoxy group, an n-butoxy group, a t-butoxy group, etc.), an aryloxy group (for example, a phenoxy group, etc.), an alkoxycarbonyl group (for example, a straight or branched alkyloxycarbonyl group such as an n-pentyloxycarbonyl group, a t-pentyloxycarbonyl group, an n-octyloxycarbonyl group, a t-octyloxycarbonyl group, etc.), an aryloxycarbonyl group (for example, a phenoxycarbonyl group, etc.), an acyl group (for example, a straight or branched alkylcarbonyl group such as an acetyl group, a stearoyl group, etc.), an acylamino group (for example, a straight or branched alkylcarbonylamino group such as an acetamide group, etc., an arylcarbonylamino group such as a benzoylamino group, etc.), an arylamino group (for example, an N-phenylamino group, etc.), an alkylamino group (for example, a straight or branched alkylamino group such as an N-n-butylamino group, an N,N-diethylamino group, etc.), a carbamoyl group (for example, a straight or branched alkylcarbamoyl group such as an n-butylcarbamoyl group, etc.), a sulfamoyl group (for example, a straight or branched alkylsulfamoyl group such as an N,N-di-n-butylsulfamoyl group, an N-n-dodecylsulfamoyl group, etc.), a sulfonamido group (for example, a straight or branched alkylsulfonylamino group such as a methylsulfonylamino group, etc., an arylsulfonylamino group such as a phenylsulfonylamino group, etc.), a sulfonyl group (for example, a straight or branched alkylsulfonyl group such as a mesyl group, etc., an arylsulfonyl group such as a tosyl group, etc.), a cycloalkyl group (for example, a cyclohexyl group, etc.), etc.

In the formulae (XI), (XII) and (XIII), preferred.

Examples are selected from the case where a 5- or 6-membered ring is formed by an alkyl group or an aryl group represented by $R^1$, $R^2$, $R^3$ and $R^4$, or at least one of combinations of $R^1$ and $R^2$, and $R^3$ and $R^4$ are linked with each other and with a carbon atom to be bonded thereto, more preferred is the case where a 6-membered ring and, particularly preferred is the instance where a benzene ring is formed by combinations of $R^1$ and $R^2$, and $R^3$ and $R^4$ with a carbon atom which are linked with each other to form a bond.

Further, M in the formulae (XI), (XII) and (XIII) represents a metal atom, preferably a nickel atom, a copper atom, an iron atom, a cobalt atom, a palladium atom or a platinum atom, more preferably a nickel atom, a copper atom, an iron atom or a cobalt atom, and most preferably a nickel atom.

The compound capable of coordinating to M represented by $Z^0$ in the formula (XII) may preferably be an alkylamine having a straight or branched alkyl group, particularly preferred is a dialkylamine or a trialkylamine wherein the total carbon atoms of the alkyl groups are 2 to 36, more preferably 3 to 24. There may be mentioned, for example, monoalkylamines such as butylamine, octylamine (for example, t-octylamine), dodecylamine (for example, n-dodecylamine), hexadecylamine, octanolamine, etc.; dialkylamines such as diethylamine, dibutylamine, dioctylamine, didodecylamine, diethanolamine, dibutanolamine, etc.; and trialkylamines such as triethylamine, tributylamine, trioctylamine, triethanolamine, tributanolamine, trioctanolamine, etc.

Typical examples of the metal complexes according to the present invention (hereinafter referred to as exemplary complexes) are shown below, but the present invention is not limited thereto.

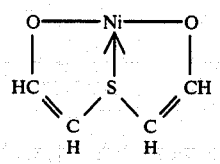
B-(1)
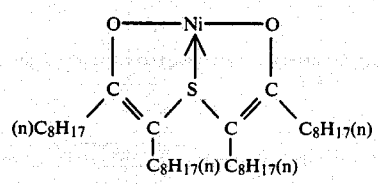
B-(2)
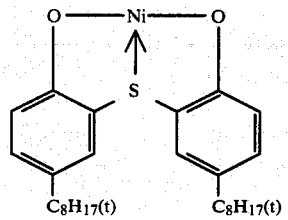
B-(3)
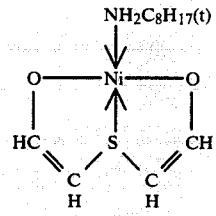
B-(4)
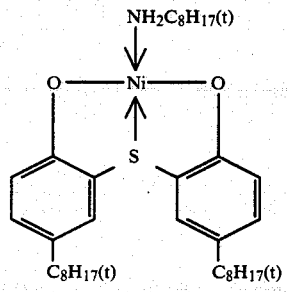
B-(5)
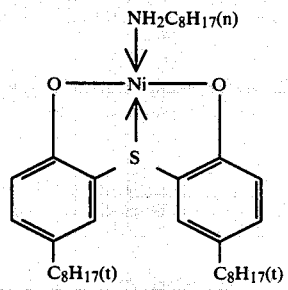
B-(6)
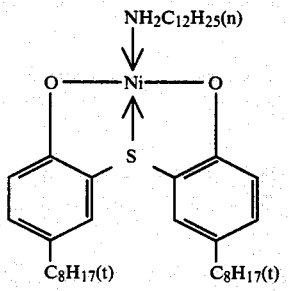
B-(7)
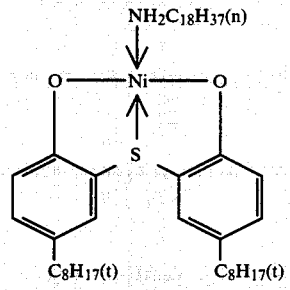
B-(8)
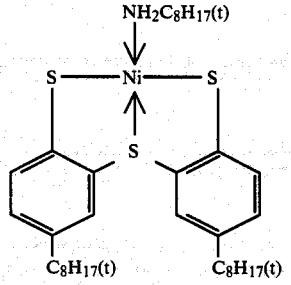
B-(9)
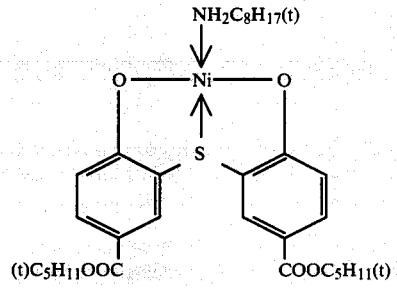
B-(10)
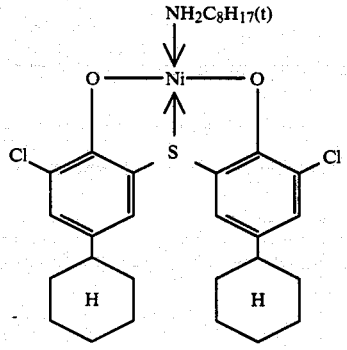
B-(11)
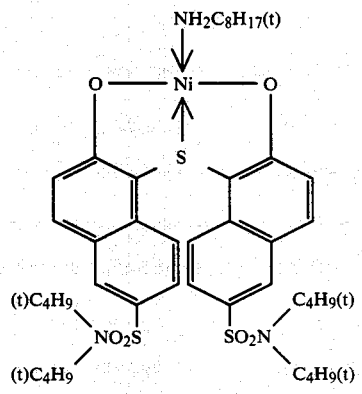
B-(12)

-continued
B-(13)
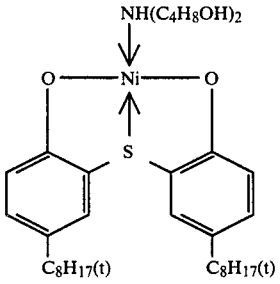
B-(14)
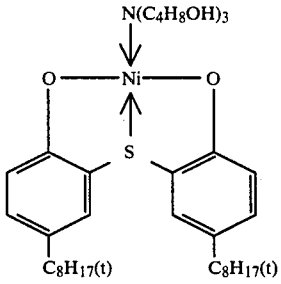
B-(15)
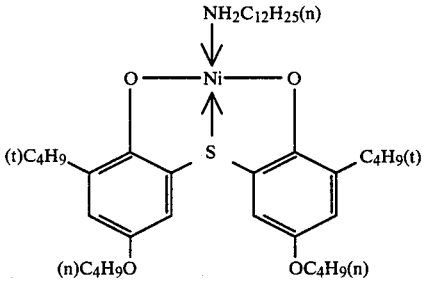
B-(16)
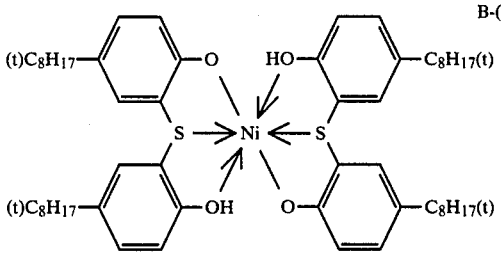
B-(17)
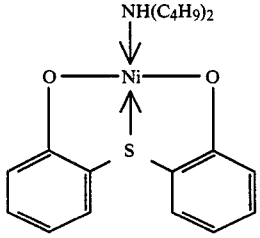
B-(18)
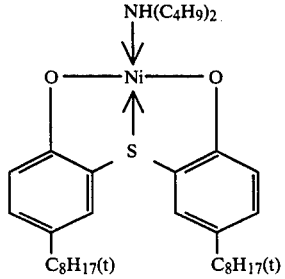
B-(19)
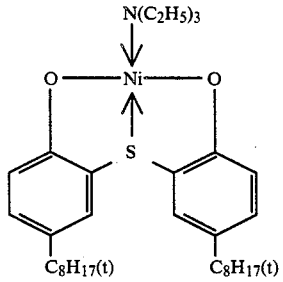
B-(20)
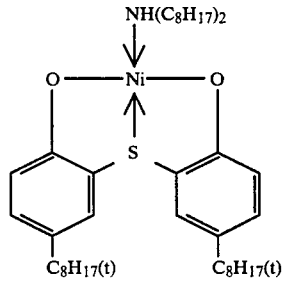
B-(21)
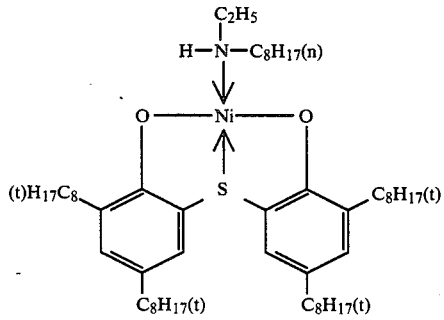
B-(22)
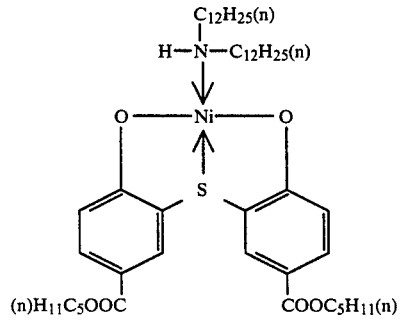

-continued
B-(23)
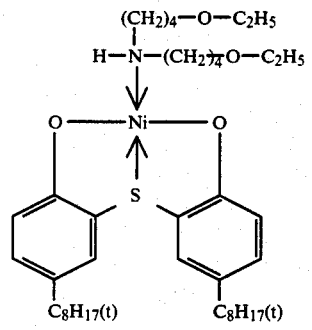
B-(24)
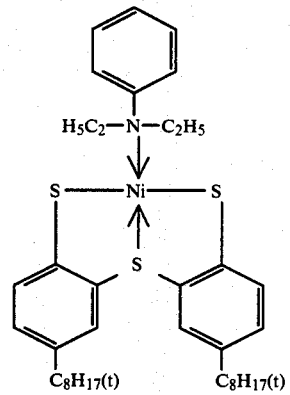
B-(25)
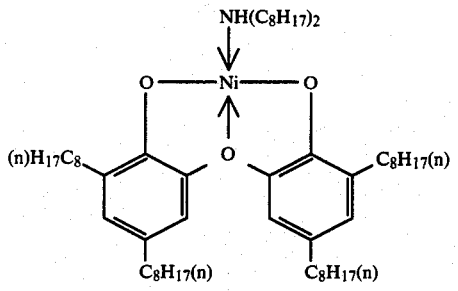
B-(26)
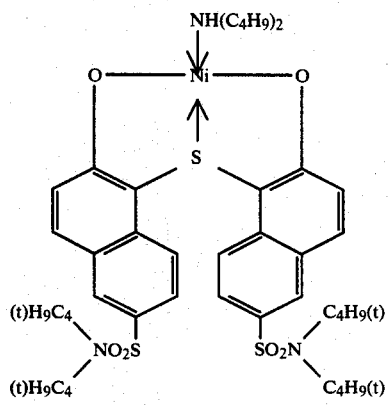
B-(27)
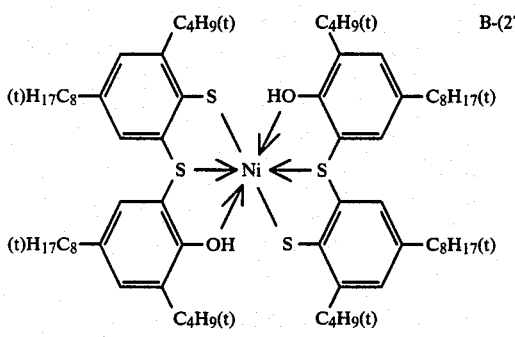
B-(28)
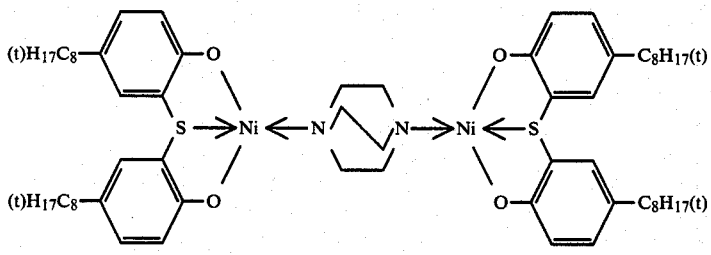
B-(29)
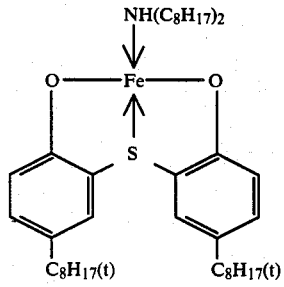
B-(30)
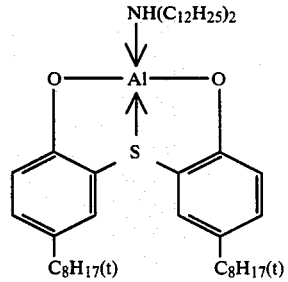

These complexes can be synthesized according to the methods as disclosed in U.K. Pat. No. 858,890, West German Offenlegunsschrift No. 20 42 652, etc.

The complex according to the present invention may be used preferably in an amount generally of 5 to 100% by weight based on the coupler according to the present invention, more preferably in an amount of 10 to 50% by weight. Also, it is preferable to use the complex according to the present invention and the coupler according to the present invention in the same layer, more preferably, to permit them to exist in the same oil droplet.

The compounds represented by the formulae (XXI), (XXII) or (XXIII) (hereinafter referred to as antioxidant) according to the present invention include the compounds as described in U.S. Pat. No. 3,935,016, No. 3,982,944, No. 4,254,216, No. 3,700,455, No. 3,746,337, No. 3,433,300, No. 3,574,627 and No. 3,573,050; British Provisional Patent Publications No. 2,066,975, No. 2,077,455 and No. 2,062,888; Japanese Provisional Patent Publications No. 21004/1980, No. 145530/1979, No. 152225/1977, No. 20327/1978 and No. 6321/1980; and Japanese Patent Publications No. 12337/1979 and No. 31625/1973 and the like.

In the formulae (XXI), (XXII) or (XXIII), $R_{1)}$ represents a hydrogen atom, an alkyl group (for example, a methyl group, an ethyl group, a propyl group, an octyl group, a dodecyl group, etc.), an acyl group (for example, an acetyl group, a benzoyl group, a benzonoyl group, etc.), a sulfonyl group (for example, a methanesulfonyl group, a butanesulfonyl group, a benzenesulfonyl group, a hexadecanesulfonyl group, etc.), a carbamoyl group (for example, an N-methylcarbamoyl group, an N,N-diethylcarbamoyl group, an N-dodecylcarbamoyl group, an N-phenylcarbamoyl group, etc.), a sulfamoyl group (for example, an N-methylsulfamoyl group, an N,N-dimethylsulfamoyl group, an N-dodecylcarbamoyl group, an N-phenylsulfamoyl group, etc.), an alkoxycarbonyl group (for example, a methoxycarbonyl group, an ethoxycarbonyl group, a benzyloxy group, etc.), and a trialkylsilyl group (for example, a trimethylsilyl group, a dimethylbutylsilyl group, etc.).

Further, $R_{2)}$, $R_{3)}$ and $R_{4)}$ in the formulae (XXI), (XXII) and (XXIII) each represent a hydrogen atom, an alkyl group (for example, a methyl group, an ethyl group, an octyl group, a lauryl group, etc.), an alkoxy group (for example, a methoxy group, an ethoxy group, an n-butyloxy group, an octyloxy group, etc.), an aryl group (for example, a phenyl group, a naphthyl group, etc.), an aryloxy group (for example, a phenoxy group, a naphthoxy group, etc.), an alkenyl group (for example, an octynyl group, etc.), an alkenoxy group (for example, an octynyloxy group, etc.), an acylamino group (for example, an acetylamino group, a parmitoylamino group, a bonzoylamino group, etc.), a halogen atom (for example, a chlorine atom, a bromine atom, etc.), an alkylthio group (for example, an octylthio group, a laurylthio group, etc.), an arylthio group (for example, a phenylthio group, etc.), an alkoxycarbonyl group (for example, a methoxycarbonyl group, an ethoxycarbonyl group, a hexadecyloxycarbonyl group, etc.), an acyloxy group (for example, an acetyloxy group, a benzoyloxy group, etc.), an acyl group (for example, an acetyl group, a valeryl group, a stearoyl group, a benzoyl group, etc.), a sulfonamido group (for example, an octylsulfonamido group, a laurylsulfonamide group, etc.) and the like. These groups represented by the $R_{2)}$, $R_{3)}$ and $R_{4)}$ may be the same or different from each other.

The $R_{5)}$, $R_{6)}$ and $R_{7)}$ each represent a hydrogen atom, a hydroxyl group, an alkyl group (for example, a methyl group, an ethyl group, a butyl group, an octyl group, a lauryl group, etc.), an alkenyl group (for example, an octynyl group, etc.), an alkoxy group (for example, a methoxy group, an ethoxy group, a butoxy group, an octoxy group, etc.), an aryl group (for example, a phenyl group, a naphthyl group, etc.), an aryloxy group (for example, a phenoxy group, a naphthoxy group, etc.), an acyloxy group (for example, an acetyloxy group, a benzoyloxy group, etc.), an alkoxycarbonyl group (for example, a methoxycarbonyl group, an ethoxycarbonyl group, an octoxycarbonyl group, etc.) and the like.

$R_{8)}$ represents an alkyl group (for example, a methyl group, an ethyl group, a propyl group, an octyl group, a benzyl group, a hexadecyl group, etc.), an alkenyl group (for example, an allyl group, an octenyl group, an oleyl group, etc.), an aryl group (for example, a phenyl group, a naphthyl group, etc.) and a heterocyclic group (for example, a pyrimidyl group, a tetrahydropyranyl group, etc.). Further, as the groups represented by $R_{12)}$, $R_{13)}$ and $R_{14)}$ which are included in $R_{8)}$ as elements thereof, those groups in the scope of the aforesaid $R_{8)}$ may be mentioned.

The $R_{9)}$ and $R_{10)}$ each represent a hydrogen atom, a halogen atom (for example, fluorine, chlorine, bromine, etc.), an alkyl group (for example, a methyl group, an ethyl group, a butyl group, a benzyl group, etc.), an alkenyl group (for example, an aryl group, an octenyl group, etc.), an alkoxy group (for example, a methoxy group, an ethoxy group, a benzyloxy group, etc.), an alkenoxy group (for example, a propenyloxy group, a hexenyloxy group, etc.) and the like.

Further, $R_{11)}$ represents a hydrogen atom, an alkyl group (for example, a methyl group, an ethyl group, a propyl group, a benzyl group, etc.), an alkenyl group (for example, an octenyl group, a hexenyl group, etc.), an aryl group (for example, a phenyl group, a naphthyl group, a methoxyphenyl group, etc.) and the like.

In the formula (XXI), preferably used compounds are those represented by the following formula:

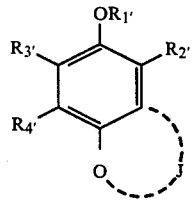

wherein $R_{1)}$, $R_{2)}$, $R_{3)}$, $R_{3)}$ and J have the same meanings as defined in the formula (XXI).

Typical examples of the compounds represented by the formulae (XXI), (XXII) and (XXIII) are shown below, but the present invention is not limited thereto.

Exemplary color fading prevention agents:

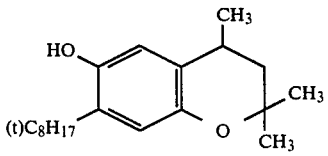

C-(1)

-continued
C-(2)
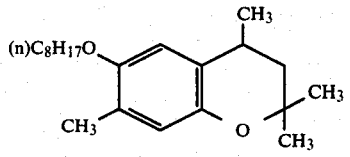
C-(3)
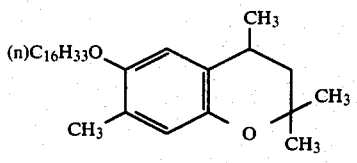
C-(4)
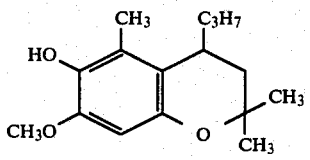
C-(5)
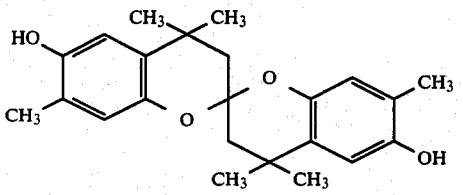
C-(6)
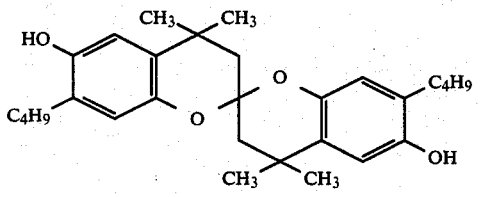
C-(7)
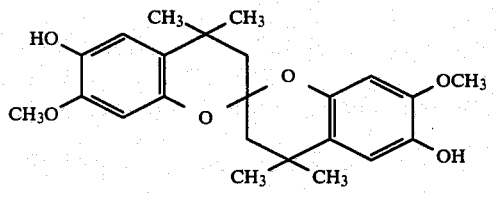
C-(8)
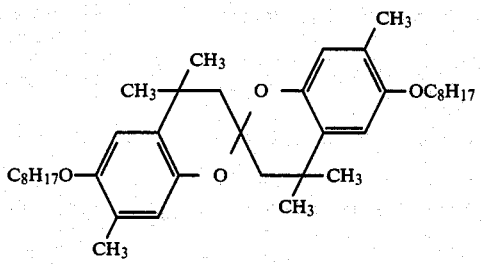
C-(9)
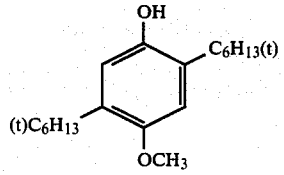
-continued
C-(10)
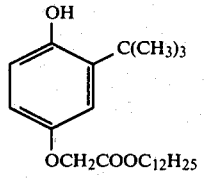
C-(11)
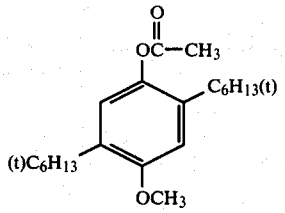
C-(12)
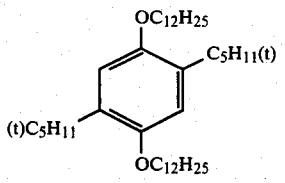
C-(13)
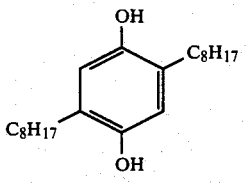
C-(14)
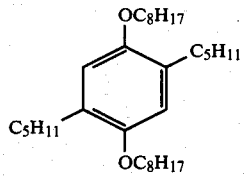
C-(15)
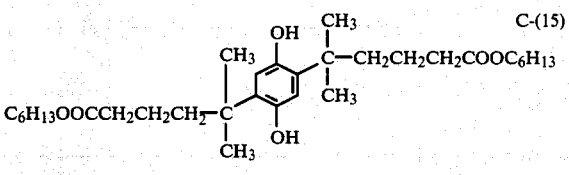
C-(16)
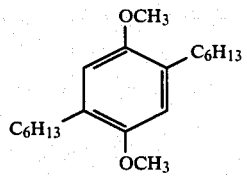
C-(17)
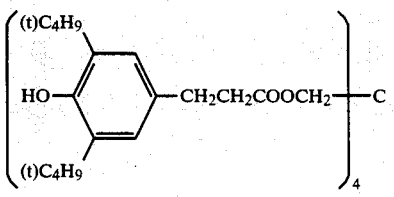

-continued

C-(18)

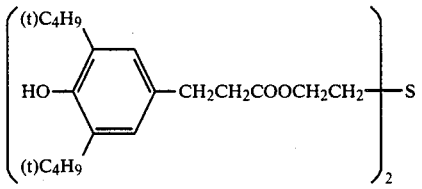

C-(19)

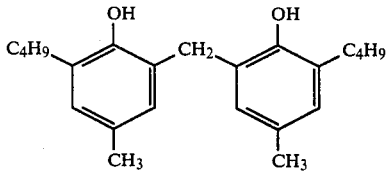

C-(20)

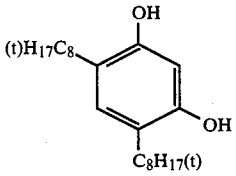

C-(21)

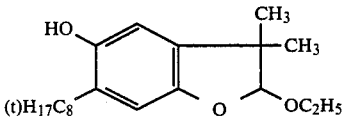

C-(22)

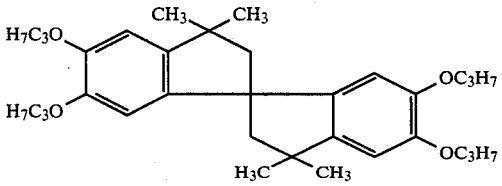

C-(23)

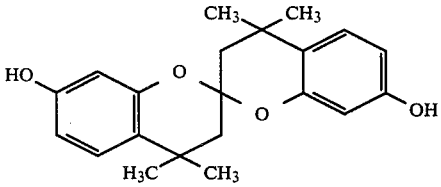

C-(24)

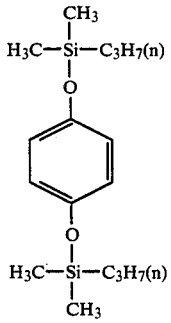

C-(25)

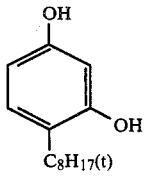

-continued

C-(26)

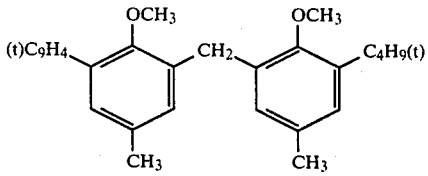

C-(27)

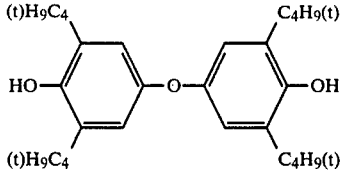

The antioxidant according to the present invention may be used preferably at in an amount of 0.01 to 1.0 mole, more preferably 0.1 to 0.4 mole per mole of the coupler.

As the method for dispersing the metal complex, the antioxidant and the coupler, there may be employed various methods such as the so-called alkali aqueous solution dispersing method, solid dispersing method, latex dispersing method, oil droplet-in-water type emulsifying method, etc., which methods can suitably be selected depending on the chemical structures of the coupler and the metal complex.

In the present invention, the latex dispersing method and the oil droplet-in-water type emulsifying method are particularly effective. These dispersing methods are well known in the art, and the latex dispersing method and its effects are described in Japanese Provisional Patent Publications No. 74538/1974, No. 59943/1976 and No. 32552/1979; and Research Disclosure, August, 1976, No. 14,850, pp. 77–79.

Suitable latices comprise homopolymers, copolymers and terpolymers of monomers, including, for example, styrene, ethyl acrylate, n-butyl acrylate, n-butyl methacrylate, 2-acetoacetoxyethyl methacrylate, 2-(methacryloyloxy)ethyltrimethylammonium methosulfate, sodium 3-(methacryloyloxy)propane-1-sulfonate, N-isopropylacrylamide, N-[2-(2-methyl-4-oxypentyl)]acrylamide, 2-acrylamido-2-methylpropanesulfonic acid, etc. As the oil droplet-in-water emulsifying method, it is possible to apply the method known in the art in which a hydrophobic additive such as coupler is dispersed. For example, there is the method in which the above diffusion resistant coupler is dissolved in a high boiling point solvent and finely dispersed in a hydrophilic colloid such as gelatin.

The above high boiling point organic solvent may include esters such as phthalate, phosphate, etc., organic acid amides, ketones, hydrocarbon compounds, etc., but preferably high boiling organic solvents with a dielectric constant of 7.5 or less and 1.9 or more, having a vapor pressure of 0.5 mm Hg or lower at 100° C. Useful high boiling point organic solvents may be exemplified by dibutyl phthalate, dioctyl phthalate, dinonyl phthalate, trioctyl phosphate, trinonyl phoshate, tricresyl phosphate, triphenyl phosphate, etc.

The light-sensitive silver halide photographic material of the present invention can be, for example, a negative or positive film for color as well as a color printing paper, and the effect of the present invention can be effectively exhibited when a color printing paper to be provided directly for viewing is employed.

The light-sensitive silver halide photographic material, typically the color printing paper, of the present invention may be either for single color or multi-color. In the case of a light-sensitive silver halide photographic material for multi-color, since the subtractive color reproduction is effected, it has generally a structure having silver halide emulsion layers containing respective couplers of magenta, yellow and cyan as the colors for photography and non-light-sensitive layers laminated in an appropriate layer number and layer order on a support, and said layer number and layer order may appropriately be changed depending on the critical performance, purpose of use, etc.

The metal complex and antioxidant according to the present invention, when employed in combination with the magenta coupler according to the present invention, can give the effect of good light fastness as a result of a specific reaction. Accordingly, it is preferable to permit the metal complex and antioxidant according to the present invention to be contained in a silver halide emulsion layer containing the magenta coupler according to the present invention, ordinarily in a green-sensitive silver halide emulsion layer, in the light-sensitive silver halide photographic material, thus permitting it to exist in the layer in which a dye, obtained by exposing the light-sensitive silver halide photographic material to exposure and developing the exposed material in the presence of a color developing agent formed through the reaction between the magenta coupler and the oxidized product of said color developing agent, is retained.

The silver halide to be used in the respective silver halide emulsion layers constituting the light-sensitive silver halide photographic material used for the present invention may include any of those conventionally used for silver halide emulsions such as silver chloride, silver bromide, silver iodide, silver chlorobromide, silver iodobromide, silver chloroiodobromide, etc. These silver halide grains may be either coarse or fine, and the distribution of grain sizes may be either narrow or broad.

Also, the crystals of these silver halide grains may be either normal crystals or twin crystals, with the ratio of (100) plane and (111) plane being any desired value. Further, the crystal structure of these silver halide grains may be either homogeneous from inner portions to outer portions or alternatively a layered structure with different inner and outer portions can be present.

These silver halides may be either of the type in which latent image is formed primarily on their surfaces or of the type in which it is formed in inner portions thereof.

These silver halide grains can be prepared according to a known method conventionally used in this field of art. Said grains may also be doped with iridium, rhodium, etc.

Further, the photographic emulsion containing the above silver halide grains may also be applied with sulfur sensitization or selenium, reducing or noble metal sensitization. It is also possible to effect optical senstization with various sensitizing dyes spectroscopically.

In the light-sensitive silver halide photographic material according to the present invention, in addition to various additives as mentioned above, there may also be added various additives such as development accelerators, film hardeners, surfactants, anti-staining agents, lubricant and other useful additives.

The support to be used for the light-sensitive silver halide photographic material used in the present invention may be any support known in the art such as plastic laminate, baryta paper, synthetic paper, polyethyleneterephthalate film and triacetate cellulose film, and various workings may usually be applied to these supports for reinforcing adhesion with the silver halide emulsion layer.

The silver halide emulsion layers and non-light-sensitive layers to be used in the present invention may be provided by coating according to various methods, such as the dip coating, the air doctor coating, the curtain coating, the hopper coating, etc.

The aromatic primary amine color developing agent to be used in the color developing solution in the present invention may include known those used widely in various color photographic processes. These developing agents include aminophenol type and p-phenylenediamine type derivatives. These compounds are used generally in the form of salts, for example, hydrochlorides or sulfates, for the sake of stability, rather than in the free state. Also, these compounds may be used at concentrations generally of about 0.1 g to about 30 g, per liter of the color developing solution, preferably of about 1 g to about 1.5 g per liter of the color developing solution.

The aminophenol type developing solution may contain, for example, o-aminophenol, p-aminophenol, 5-amino-2-oxytoluene, 2-amino-3-oxytoluene, 2-oxy-3-amino-1,4-dimethylbenzene and the like.

Particularly useful primary aromatic amino type color developing agents are N,N'-dialkyl-p-phenylenediamine type compounds, of which the alkyl group and phenyl group may be substituted by any desired substituent. Examples of particularly useful compounds may include N,N'-diethyl-p-phenylenediamine hydrochloride, N-methyl-p-phenylenediamine hydrochloride, N,N'-dimethyl-p-phenylenediamine hydrochloride, 2-amino-5-(N-ethyl-N-dodecylamino)-toluene, N-ethyl-N-$\beta$-methanesulfonamidoethyl-3-methyl-4-aminoaniline sulfate, N-ethyl-N-$\beta$-hydroxyethylaminoaniline, 4-amino-3-methyl-N,N'-diethylaniline, 4-amino-N-(2-methoxyethyl)-N-ethyl-3-methylaniline-p-toluenesulfonate and the like.

In the color developing solution to be used in the processing of the present invention, in addition to the above primary aromatic amine type color developing agent, it is also possible to incorporate an alkali agent such as sodium hydroxide, sodium carbonate, potassium carbonate and the like, an alkali metal sulfite, an alkali metal bisulfite, an alkali metal thiocyanate, an alkali metal halide, benzyl alcohol, a water softening agent and a thickening agent, etc., as desired. The pH value of the color developing solution is usually 7 or higher, most commonly about 10 to about 13.

In the present invention, after color developing processing, processing with a processing solution having fixing ability is carried out. When the processing solution having said fixing ability is a fixing solution, bleaching processing is performed prior thereto. As the bleaching agent to be used in said bleaching step, a metal complex of an organic acid may be used, and said metal complex has the action of color forming the non-color formed portion of the color forming agent simultaneously with oxidizing the metal salt to return it to silver halide, it can be an organic acid such as aminopolycarboxylic acid or oxalic acid, citric acid, etc. coordinated with metal ions such as of iron, cobalt, copper, etc. The most preferred organic acids for formation of such a metal complex of an organic acid may include polycarboxylic acids or aminopolycarboxylic acids. These polycarboxylic acids or aminopolycarboxylic acids may be used in the form of their alkali metal salts, ammonium salts or water-soluble amine salts.

Typical examples of these are enumerated below.

[I] Ethylenediaminetetraacetic acid

[II] Disodium ethylenediaminetetraacetate

[III] Tetra(trimethylammonium) ethylenediaminetetraacetate

[IV] Tetrasodium ethylenediaminetetraacetate

[V] Sodium nitrilotriacetate

The bleaching agent used may contain a metal complex of an organic acid as described above as the bleaching agent together with various additives. As such additives, it is particularly desirable to incorporate a rehalogenating agent such as an alkali halide or an ammonium halide, for example, potassium bromide, sodium bromide, sodium chloride, ammonium bromide, etc., a metal salt, a chelating agent. Also, those known additives conventionally added to into the bleaching solution, including pH buffering agents such as borates, oxalates, acetates, carbonates, phosphates, etc., alkylamines, polyethyleneoxides, etc.

Further, the fixing solution and the bleach-fixing solution may also contain pH buffering agents comprising sulfites such as ammonium sulfite, potassium sulfite, ammonium bisulfite, potassium bisulfite, sodium bisulfite, ammonium metalbisulfite, potassium metalbisulfite, sodium metalbisulfite, etc., or various salts such as boric acid, borax, sodium hydroxide, potassium hydroxide, sodium carbonate, potassium carbonate, sodium bisulfite, sodium bicarbonate, potassium bicarbonate, acetic acid, sodium acetate, ammonium hydroxide, etc. either singly or as a combination of two or more compounds.

When the processing of the present invention is performed, while supplementing a bleach-fixing supplemental agent into the bleach-fixing solution (bath), said bleach-fixing solution (bath) may contain a thiosulfate, a thiocyanate or a sulfite, etc., or these salts may be contained in said bleach-fixing supplemental solution and supplemented to the processing bath.

In the present invention, for enhancing the activity of the bleach-fixing solution, blowing of air or oxygen may be effected if desired into the bleach-fixing bath and the storage tank for the bleach-fixing supplemental solution, or a suitable oxidizing agent such as hydrogen peroxide, a hydrobromic acid salt, a persulfate, etc. may adequately be added.

The present invention is described in more detail by referring to the following Examples, by which the embodiments of the present invention are not limited at all.

EXAMPLE 1

A solution of 40 g of the above exemplary magenta coupler (5) in a solvent mixture of 40 ml of dioctyl phthalate and 100 ml of ethyl acetate was added to 300 ml of a 5% aqueous gelatin solution containing sodium dodecylbenzenesulfonate, followed by dispersing by means of a homogenizer. The resultant dispersion was mixed with 500 g of a green-sensitive silver chlorobromide emulsion (containing 30 g of silver) and a coating aid was added thereto to prepare a coating solution. Subsequently, the coating solution was applied onto a polyethylene-coated paper support, and further a coating solution containing 2-(2'-hydroxy-3',5'-di-t-amylbenzotriazole), gelatin, an extender and a film hardener was provided by coating to give a protective film. During this operation, the amount of 2-(2'-hydroxy-3',5'-di-t-amyl-benzotriazole) was made 5 mg/dm$^2$ and that of gelatin 15 mg/dm$^2$ to prepare a light-sensitive silver halide photographic material, which is called Sample 1.

Next, Samples 2 to 9 were prepared in the same manner as preparation of Sample 1 except for adding metal complexes and antioxidants according to the present invention in combinations as indicated in Table 1 to the emulsion layer of Sample 1.

These samples were subjected to optical wedge exposure by means of a sensitometer (Model KS-7, produced by Konishiroku Photo Industry K.K.), followed by the processing shown below.

| Processing steps | Processing temperature | Processing time |
|---|---|---|
| Color developing | 32.8° C. | 3 min. 30 sec. |
| Bleach-fixing | 32.8° C. | 1 min. 30 sec. |
| Water washing | 32.8° C. | 3 min. 30 sec. |

Compositions of processing solutions used in the above processing steps are as follows:

| | |
|---|---|
| [Color developing solution] | |
| 4-Amino-3-methyl-N—ethyl-N—(β-methanesulfonamidethyl)aniline sulfate | 5 g |
| Benzyl alcohol | 15 ml |
| Sodium Hexamethaphosphate | 2.5 g |
| Anhydrous sodium sulfite | 1.85 g |
| Sodium bromide | 1.4 g |
| Potassium bromide | 0.5 g |
| Borax | 39.1 g |
| (made up to a total quantity of one liter with addition of water, and adjusted to pH 10.3). | |
| [Bleach-fixing solution] | |
| Ferric ammonium ethylenediaminetetraacetate | 61.0 g |
| Diammonium ethylenediaminetetraacetate | 5.0 g |
| Ammonium thiosulfate | 124.5 g |
| Ammonium metabisulfite | 13.5 g |
| Anhydrous sodium sulfite | 2.7 g |
| (made up to a total quantity of one liter with addition of water). | |

After processing, light-resistance of each sample obtained was measured in the following manner.

[Light-resistance test]

The fading percentage $[(D_0-D)/D_0\times 100$; $D_0$: initial density (1.0), D: density after fading] was measured when the dye image formed on each sample was exposed to the sunlight by use of Underglass outdoor exposure stand for 600 hours.

These results are shown in Table 1.

TABLE 1

| Sample No. | Metal complex | Anti-oxidant | Color fading (%) |
|---|---|---|---|
| 2 (Control) | B-5 (0.4) | — | 80 |
| 3 (Control) | B-8 (0.4) | — | 79 |
| 4 (Control) | — | C-5 (0.4) | 86 |
| 5 (Control) | — | C-8 (0.4) | 87 |
| 6 (This invention) | B-5 (0.2) | C-5 (0.2) | 47 |
| 7 (This invention) | B-5 (0.2) | C-8 (0.2) | 48 |
| 8 (This invention) | B-8 (0.2) | C-5 (0.2) | 46 |
| 9 (This invention) | B-8 (0.2) | C-8 (0.2) | 47 |

TABLE 1-continued

| Sample No. | Metal complex | Anti-oxidant | Color fading (%) |
|---|---|---|---|
| 1 (Control) | — | — | 95 |

The numerical values in the brackets indicate molar ratios relative to the coupler.

As apparently seen from Table 1, in the samples according to the present invention, light fading of the dye obtained from the magenta coupler (5) is little. This is an unexpected effect for prevention against light fading which cannot be obtained by the respective single color fading agent.

EXAMPLE 2

On a support consisting of a polyethylene-coated paper, the respective layers shown below were provided successively by coating to prepare a light-sensitive silver halide photographic material for multi-color.

First layer: blue-sensitive silver halide emulsion layer

A composition containing 8 mg/dm$^2$ of α-pivalyl-α-(1-benzyl-2,4-dioxo-imidazolidin-3-yl)-2-chloro-5-[γ-(2,4-di-t-amylphenoxy)butyramido]-acetanilide as the yellow coupler, 3 mg/dm$^2$ as calculated on silver of a blue-sensitive silver halide emulsion (silver chlorobromide emulsion containing 90 mole % of silver bromide), 3 mg/dm$^2$ of 2,4-di-t-butylphenol-3',5'-di-t-amyl-4'-hydroxybenzoate, 3 mg/dm$^2$ of dioctyl phthalate and 16 mg/dm$^2$ of gelatin was provided by coating.

Second layer: intermediate layer

Gelatin was provided by coating to a coating amount of 4 mg/dm$^2$.

Third layer: green-sensitive silver halide emulsion layer

A composition containing 4 mg/dm$^2$ of the above exemplary magenta coupler (71), 2 mg/dm$^2$ as calculated on silver of green-sensitive chlorobromide emulsion, 4 mg/dm$^2$ of dioctyl phthalate and 16 mg/dm$^2$ of gelatin was provided by coating.

Fourth layer: intermediate layer

A composition containing 3 mg/dm$^2$ of 2-hydroxy-3',5'-di-t-amylphenol)-benzotriazole and 3 mg/dm$^2$ of 2-(2'-hydroxy-3',5'-di-t-butylphenol)-benzotriazole as UV-absorbers, 4 mg/dm$^2$ of dioctyl phthalate and 14 mg/dm$^2$ of gelatin was provided by coating.

Fifth layer: red-sensitive silver halide emulsion layer

A composition containing 4 mg/dm$^2$ of 2,4-dichloro-3-methyl-6-[α-(2,4-di-t-amylphenoxy)butyramido]-phenol as cyan coupler, 2 mg/dm$^2$ of dioctyl phthalate, 3 mg/dm$^2$ as calculated on silver of a red-sensitive silver chlorobromide emulsion and 16 mg/dm$^2$ of gelatin was provided by coating.

Sixth layer: intermediate layer

A composition containing 2 mg/dm$^2$ of 2-(2'-hydroxy-3',5'-di-t-amylphenol)-benzotriazole, 2 mg/dm$^2$ of 2-(2'-hydroxy-3',5'-di-t-butylphenol)-benzotriazole as UV-absorbers, 2 mg/dm$^2$ of dioctyl phthalate and 6 mg/dm$^2$ of gelatin was provided by coating.

Seventh layer: protective layer

Gelatin was provided to a coating amount of 9 mg/dm$^2$.

The sample thus prepared is called Sample 10.

Next, Samples 11 through 29 were prepared in the same manner as preparation of Sample 10 except for changing the combination of the metal complex, the antioxidant and the magenta coupler in the third layer of Sample 10 to those as indicated in Table 2.

For the samples thus prepared, the same exposure as in Example 1 was applied. However, optical wedge exposure was effected by use of green light in order to obtain a monochromatic sample of magenta. For each sample after exposure, light resistance of the magenta dye image was tested similarly as in Example 1. Further, in order to inspect the coloring due to the metal complex, the measurement of the coloring density was carried out in the following manner. Also for examination of the color purity of the magenta color formed sample, spectroscopic reflective density spectrum was measured in the following manner.

[Measurement of coloring density]

A spectroscopic reflection spectrum of a white portion of each sample was measured by means of a color analyzer Model 607 (trade name, produced by Hitachi Co., Ltd.), and the difference of the spectroscopic reflection density at 440 nm of each sample from those at 440 nm of Sample 10 as a standard.

[Measurement of spectroscopic reflective density spectrum of magenta color formed sample]

The spectroscopic refelection spectrum of the magenta color formed portion of each sample was measured by means of a color analyzer Model 607 (produced by Hitachi Co., Ltd.). In this measurement, the maximum density of the absorption spectrum at the visible region of each sample was normalized as 1.0.

The reflective density at 420 nm of each sample was defined as the side absorption density and used as a measure of color purity.

These results are shown in Table 2.

TABLE 2

| Sample No. | Magenta coupler | Metal complex | Anti-oxidant | Color fading [%] | Coloring density | Side Absorption density |
|---|---|---|---|---|---|---|
| 10 (Control) | 71 | — | — | 92 | 0.000 | 0.20 |
| 11 (Control) | 71 | B-6 (0.4) | — | 79 | 0.004 | 0.20 |
| 12 (Control) | 71 | B-7 (0.4) | — | 78 | 0.004 | 0.20 |
| 13 (Control) | 71 | — | C-14 (0.4) | 85 | 0.000 | 0.20 |
| 14 (Control) | 71 | — | C-22 (0.4) | 83 | 0.000 | 0.20 |
| 15 (This invention) | 71 | B-6 (0.2) | C-14 (0.2) | 45 | 0.002 | 0.20 |
| 16 (This invention) | 5 | B-6 (0.2) | C-14 (0.2) | 51 | 0.002 | 0.20 |
| 17 (This invention) | 8 | B-6 (0.2) | C-14 (0.2) | 52 | 0.002 | 0.20 |
| 18 (This invention) | 36 | B-6 (0.2) | C-14 (0.2) | 37 | 0.002 | 0.20 |

TABLE 2-continued

| Sample No. | Magenta coupler | Metal complex | Anti-oxidant | Color fading [%] | Coloring density | Side Absorption density |
|---|---|---|---|---|---|---|
| 19 (This invention) | 56 | B-6 (0.2) | C-14 (0.2) | 36 | 0.002 | 0.20 |
| 20 (This invention) | 71 | B-6 (0.2) | C-22 (0.2) | 41 | 0.002 | 0.20 |
| 21 (This invention) | 71 | B-16 (0.2) | C-14 (0.2) | 15 | 0.002 | 0.20 |
| 22 (This invention) | 71 | B-19 (0.2) | C-22 (0.2) | 16 | 0.002 | 0.20 |
| 23 (Control) | 71 | Control metal complex B (0.4) | — | 75 | 0.042 | 0.24 |
| 24 (Control) | 71 | Control metal complex B (0.2) | C-14 (0.2) | 81 | 0.021 | 0.22 |
| 25 (Control) | 71 | — | Control compound C (0.4) | 91 | 0.000 | 0.20 |
| 26 (Control) | 71 | B-6 (0.2) | Control compound C (0.4) | 85 | 0.002 | 0.20 |
| 27 (Control) | Control coupler A | — | — | 85 | 0.000 | 0.36 |
| 28 (Control) | Control coupler A | — | C-14 (0.4) | 39 | 0.000 | 0.36 |
| 29 (Control) | Control coupler A | B-6 (0.2) | C-14 (0.2) | 43 | 0.002 | 0.36 |

Control metal complex B

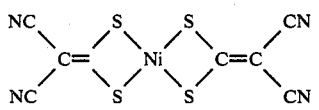

Control coupler A

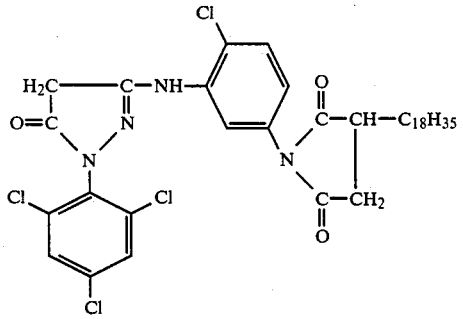

Control compound C: Ascorbic acid dilaurate

Control metal complex-1 and Control antioxidant-1 are the same as in Example 1.

It can be seen from Table 2 that the combinations of the metal complex, the antioxidant and the magenta coupler according to the present invention are greater in the effect of improving light resistance. This is an unexpected effect for prevention against light fading which cannot be obtained by the samples using respective additives singly. Further, when the control metal complex was used, the above synergistic effect cannot be seen and the whitening degree of the photographic image is lowered since the coloring degree due to the metal complex is large. Moreover, photographic performances (sensitivity, gradation, etc.) are remarkably reduced in the control samples. Furthermore, as to the above synergistic effect with respect to the light resistance, it can be understood that when the metal complex and antioxidant are employed in combination with the magenta coupler of the present invention, a particularly large effect could be obtained.

In the samples of the present invention, the magenta images having good light resistance and less side absorption could be obtained and also the photographic images with less in deterioration of whiteness, sensitivity, gradation, etc. could be obtained.

EXAMPLE 3

On a transparent support comprising a cellulose triacetate film subjected to subbing treatment having a halation preventive layer (containing 0.40 g of black colloid silver and 3.0 g of gelatin), the respective layers shown below were provided successively by coating to prepare Sample No. 27.

First layer: low sensitivity layer of red-sensitive silver halide emulsion layer A low sensitivity layer of a red-sensitive silver halide emulsion layer containing a dispersion of a solution of 1.8 g of a silver iodobromide emulsion (Emulsion I) color sensitized to red-sensitive, 0.8 g of 1-hydroxy-4-(β-methoxyethylaminocarbonylmethoxy)-N-[δ-(2,4-di-t-amylphenoxy)butyl]-2-naphthoamide (called D-1), 0.075 g of 1-hydroxy-4-[4-(1-hydroxy-8-acetamido-3,6-disulfo-2-naphthylazo)phenoxy]-N-[δ-(2,4-di-t-amylphenoxy)butyl]-2-naphthoamido.disodium (called CC-1), 0.015 g of 1-hydroxy-2,4[δ-(2,4-di-t-amylphenoxy)-n-butyl]naphthoamide and 0.07 g of 4-octadecylsuccinimido-2-(1-phenyl-5-tetrazolylthio)-1-indanone (called E-1) dissolved in 0.65 g of tricresyl phosphate (called TCP) emulsified in an aqueous solution containing 1.85 g of gelatin.

Second layer: high sensitivity layer of red-sensitive silver halide emulsion layer A high sensitivity layer of a red-sensitive silver halide emulsion layer containing a dispersion of a solution of 1.2 g of a silver iodobromide emulsion (Emulsion II) color sensitized to red-sensitive, 0.21 g of the cyan coupler (D-1), 0.02 g of the colored cyan coupler (CC-1)

dissolved in 0.23 g of TCP emulsified in an aqueous solution containing 1.2 g of gelatin.

Third layer: intermediate layer

An intermediate layer containing a solution of 0.8 g of gelatin.

Fourth layer: low sensitivity layer of green-sensitive silver halide emulsion layer A low sensitivity layer of a green-sensitive silver halide emulsion containing a dispersion of 0.80 g of the Emulsion I color sensitized to green-sensitive, 0.80 g of the exemplary compound (5) and 0.01 g of DIR compound (F-1) dissolved in 0.95 g of di-t-nonylphenol emulsified in an aqueous solution containing 2.2 g of gelatin.

Fifth layer: high sensitivity layer of green-sensitive silver halide emulsion layer A high sensitivity layer of a green-sensitive silver halide emulsion containing a dispersion of a solution of 1.8 g of the Emulsion II color sensitized to green-sensitive and 0.20 g of the exemplary compound (5) dissolved in 0.25 g of diethyllauric acid amide emulsified in an aqueous solution containing 1.9 g of gelatin.

Sixth layer: yellow filter

A yellow filter layer containing 0.15 g of yellow colloid silver, a solution of 0.2 g of the color staining preventive (HQ-1) dissolved in 0.11 g of DBP and 1.5 g of gelatin.

Seventh layer: low sensitivity layer of blue-sensitive silver halide emulsion layer A low sensitivity layer of a blue-sensitive silver halide emulsion layer containing a dispersion of a solution of 0.2 g of the Emulsion I color sensitized to blue-sensitive and 1.5 g of α-pivaloyl-α-(1-benzyl-2-phenyl-3,5-dioxyisoimidazolidin-4-yl)-2-chloro-5-[α-dodecyloxycarbonyl)ethoxycarbonyl]acetanilide (called Y-1) dissolved in 0.6 g of TCP emulsified in an aqueous solution containing 1.9 g of gelatin.

Eighth layer: high sensitivity layer of blue-sensitive silver halide emulsion layer A high sensitivity layer of a blue-sensitive silver halide emulsion layer containing 0.9 g of an emulsion comprising AgBrI containing 2 mole% of AgI sensitized to blue-sensitive and 0.30 g of the yellow coupler (Y-1) dissolved in 0.65 g of TCP emulsified in an aqueous solution containing 1.5 g of gelatin.

Ninth layer: protective layer

A protective layer containing 0.23 g of gelatin. According to the same procedures as in the preparation of Sample 30, Samples No. 31 to No. 36 were prepared except for replacing the metal complex and the antioxidant used in the green-sensitive emulsion layer of Sample No. 30 as shown in Table 3. Further, samples were prepared by replacing the high boiling point organic solvent in the fourth and fifth layers in Sample No. 36 with trioctyl phosphate and dioctyl phthalate to prepare Samples No. 37 and No. 38, respectively.

Each of Samples No. 30 to No. 38 was subjected to wedge exposure by use of green light, followed by the developing processing shown below.

| Developing processings (38° C.) | |
|---|---|
| Color developing | 3 min. 15 sec. |
| Bleaching | 6 min. 30 sec. |
| Water washing | 3 min. 15 sec. |
| Stabilizing | 1 min. 30 sec. |
| Drying | |

The composition of the processing solutions used in each of the processing steps are as follows:

| | |
|---|---|
| [Color developing solution] | |
| 4-Amino-3-methyl-N—ethyl-N—(β-hydroxyethyl)aniline · sulfate | 4.75 g |
| Anhydrous sodium sulfite | 4.25 g |
| Hydroxylamine · ½ sulfate | 2.0 g |
| Anhydrous potassium carbonate | 37.5 g |
| Sodium bromide | 1.3 g |
| Nitrilotriacetic acid · trisodium salt (monohydrate) | 2.5 g |
| Potassium hydroxide | 1.0 g |
| (made up to one liter with addition of water, and adjusted to pH 10.02). | |
| [Bleaching solution] | |
| Ammonium ethylenediaminetetraacetate | 100 g |
| Diammonium ethylenediaminetetraacetate | 10 g |
| Ammonium bromide | 150 g |
| Glacial acetic acid | 10.0 ml |
| (made up to one liter with addition of water, and adjusted to pH 6.0 with aqueous ammonia). | |
| [Fixing solution] | |
| Ammonium thiosulfate | 175.0 g |
| Anhydrous sodium sulfite | 8.5 g |
| Sodium metabisulfite | 2.3 g |
| (made up to one liter with addition of water, and adjusted to pH 6.0 with acetic acid). | |
| [Stabilizing solution] | |
| Formalin (37% aqueous solution) | 1.5 ml |
| Konidax (produced by Konishiroku Photo Industry Co., Ltd.) | 7.5 ml |
| (made up to one liter with addition of water). | |

Light-resistance of the samples as prepared above was examined in the same manner as in Example 1.

The results are shown in Table 3.

TABLE 3

| Sample No. | Metal complex | Anti-oxidant | Color fading (%) |
|---|---|---|---|
| 30 (Control) | — | — | 98 |
| 31 (Control) | — | C-3 (0.4) | 91 |
| 32 (Control) | — | C-12 (0.4) | 90 |
| 33 (This invention) | B-16 (0.2) | C-3 (0.2) | 38 |
| 34 (This invention) | B-16 (0.2) | C-12 (0.2) | 37 |
| 35 (This invention) | B-19 (0.2) | C-3 (0.2) | 36 |
| 36 (This invention) | B-19 (0.2) | C-12 (0.2) | 35 |
| 37 (This invention) | B-19 (0.2) | C-12 (0.2) | 25 |
| 38 (This invention) | B-19 (0.2) | C-12 (0.2) | 24 |

As can be clearly seen from Table 3, the samples of the present invention have less light color fading of dye and color fading effect which could not be expected from effects of singly used respective color fading preventives could be obtained.

Light resistance of the magenta coupler according to the present invention, which is good in color purity and useful as the diequivalent coupler while not so good in light resistance, could be further improved due to synergistic effect to a great extent by combining it with the metal complex according to the present invention as well as the antioxidant such as a phenol series or a phenyl ether series so that applicable range of the metal complex could be extended.

We claim:

1. A light-sensitive silver halide photographic material, comprising at least one coupler represented by the formula (I) shown below, at least one of the compounds represented by the formulae (XI), (XII) and (XIII) shown below and at least one of the compounds represented by the formulae (XXI), (XXII) and (XXIII):

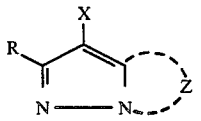

(I)

wherein Z represents a group of non-metallic atoms necessary for forming a nitrogen-containing heterocyclic ring which may have a substituent; X is hydrogen or a substituent eliminatable through reaction with the oxidized product of a color developing agent; and R is hydrogen or a substituent;

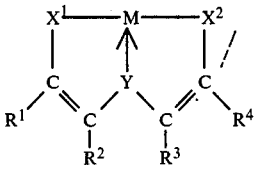

(XI)

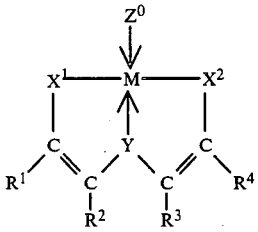

(XII)

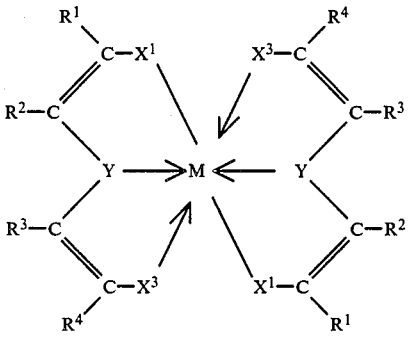

(XIII)

wherein M represents a metal atom; $X^1$ and $X^2$ each represents an oxygen atom, a sulfur atom or —$NR^5$—, wherein $R^5$ represents hydrogen, an alkyl group, an aryl group or a hydroxyl group; $X^3$ represents a hydroxyl group or a mercapto group; Y represents an oxygen atom or a sulfur atom; $R^1$, $R^2$, $R^3$ and $R^4$ each represents a hydrogen atom, a halogen atom a cyano group, or an alkyl group, an aryl group, a cycloalkyl group or a heterocyclic group each of which is bonded to a carbon atom directly or via a divalent linking group, provided that at least one of the combination of $R^1$ and $R^2$, and $R^3$ and $R^4$ may be formed as a 5- or 6-membered ring together with a carbon atom to which it is linked and bonded to each other; and $Z^0$ represents a compound capable of coordinating to M or its residual group;

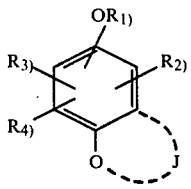

(XXI)

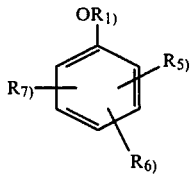

(XXII)

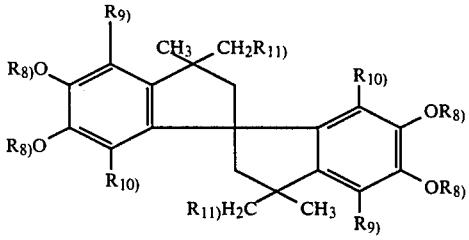

(XXIII)

wherein, in the formulae (XXI) and (XXII), $R_{1)}$ represents a hydrogen atom, an alkyl group, an acyl group, a sulfonyl group, a carbamoyl group, a sulfamoyl group, an alkoxycarbonyl group or a trialkylsilyl group; J represents a group of non-metallic atoms necessary for forming a 5- or 6-membered ring with a carbon atom or an oxygen atom to be bonded wherein each of said 5- or 6-membered rings may have a bis-spiro bond; $R_{2)}$, $R_{3)}$ and $R_{4)}$ each represents a hydrogen atom, an alkyl group, an alkoxy group, an aryl group, an aryloxy group, an alkenyl group, an alkenoxy group, an acylamino group, a halogen atom, an alkylthio group, an arylthio group, an alkoxycarbonyl group, an acyloxy group, an acyl group or a sulfonamide group, and wherein the groups represented by $R_{2)}$, $R_{3)}$ and $R_{4)}$ may be the same or different from each other; $R_{5)}$, $R_{6)}$ and $R_{7)}$ each represent a hydrogen atom, a hydroxy group, an alkyl group, an alkenyl group, an alkoxy group, an aryl group, an aryloxy group, an acyloxy group or an alkoxycarbonyl group, provided that the total number of the carbon atoms of the radicals represented by $R_{5)}$ to $R_{7)}$ is 8 or more, and wherein the groups represented by the $R_{5)}$, $R_{6)}$ and $R_{7)}$ may be the same or different from each other; in the formula (XXIII), $R_{8)}$ represents an alkyl group, an alkenyl group, an aryl group, a heterocyclic group, an $R_{12)}$—CO— group, an $R_{13)}$—$SO_2$— group or an $R_{14)}$—NHCO— group; $R_{9)}$ and $R_{10)}$ each represents a hydrogen atom, a halogen atom, an alkyl group, an alkenyl group, an alkoxy group or an alkenoxy group; $R_{11)}$ represents a hydrogen atom, an alkyl group, an alkenyl group or an aryl group; and $R_{12)}$, $R_{13)}$ and $R_{14)}$ each represents an alkyl group, an alkenyl group, an aryl group or a heterocyclic group.

2. A light-sensitive silver halide photographic material according to claim 1, wherein the coupler represented by the formula (I) is a coupler having one of the formulae (II) to (VII):

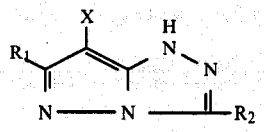
(II)

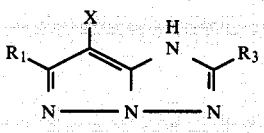
(III)

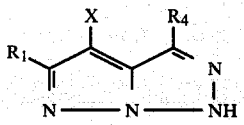
(IV)

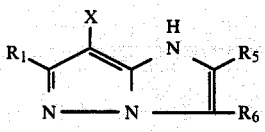
(V)

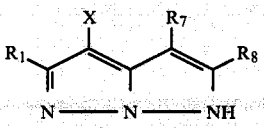
(VI)

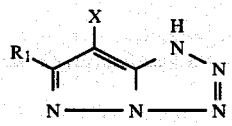
(VII)

wherein $R_1$ to $R_8$ and X have the same meanings as the R and X in the formula (I).

3. A light-sensitive silver halide photographic material according to claim 1, wherein the coupler represented by the formula (I) is a coupler having the formula (VIII):

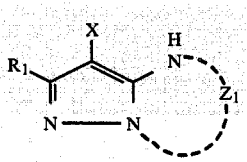
(VIII)

wherein $R_1$, X and $Z_1$ have the same meanings as R, X and Z in the formula (I).

4. A light-sensitive silver-halide photographic material according to claim 1, wherein said substituents R and $R_1$ each have the formula (IX):

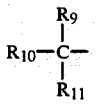
(IX)

wherein each of $R_9$, $R_{10}$ and $R_{11}$ represents a hydrogen atom, a halogen atom, an alkyl group, a cycloalkyl group, an alkenyl group, a cycloalkenyl group, an alkynyl group, an aryl group, a heterocyclic group, an acyl group, a sulfonyl group, a sulfinyl group, a phosphonyl group, a carbamoyl group, a sulfamoyl group, a cyano group, a spiro compound residual group, a bridged hydrocarbon compound residual group, an alkoxy group, an aryloxy group, a heterocyclicoxy group, a siloxy group, an acyloxy group, a carbamoyloxy group, an amino group, an acylamino group, a sulfonamide group, an imide group, an ureido group, a sulfamoylamino group, an alkoxycarbonylamino group, an aryloxycarbonylamino group, an alkoxycarbonyl group, an aryloxycarbonyl group, an alkylthio group, an arylthio group or a heterocyclicthio group.

5. A light-sensitive silver halide photographic material according to claim 4, wherein two of said $R_9$ to $R_{11}$ are alkyl groups.

6. A light-sensitive silver halide photographic material according to claim 4, wherein one of said $R_9$ to $R_{11}$ is a hydrogen atom, and the remainder are bonded together with the root carbon atom to form a cycloalkyl group.

7. A light-sensitive silver halide photographic material according to claim 1, wherein the amount of the coupler represented by the formula (I) is within the range of from $1\times10^{-3}$ mole to $5\times10^{-1}$ mole per mole of the silver halide.

8. A light-sensitive silver halide photographic material according to claim 1, wherein the amount of the compound represented by the formulae (XI), (XII) and (XIII) is 5 to 100% by weight based on the coupler.

9. A light-sensitive silver halide photographic material according to claim 2, wherein the coupler represented by the formula (I) is a coupler having the formulae (II) or (III).

10. A light-sensitive silver halide photographic material according to claim 9, wherein the coupler represented by the formula (I) is a coupler having the formula (II).

11. A light-sensitive silver halide photographic material according to claim 9, wherein the coupler represented by the formula (I) is a coupler having the formula (III).

12. A light-sensitive silver halide photographic material according to claim 1, wherein $X^1$ and $X^2$ in the formulae (XI), (XII) and (XIII) are each oxygen.

13. A light-sensitive silver halide photographic material according to claim 1, wherein the coupler represented by the formula (I) is dissolved in a high boiling point solvent and finely dispersed in a hydrophilic colloid.

14. A light-sensitive silver halide photographic material according to claim 13, wherein said high boiling point organic solvent has a dielectric constant of not exceeding 7.5 but which is at least 1.9.

15. A light-sensitive silver halide photographic material according to claim 1, wherein each Y in the formulae (XI), (XII) and (XIII) is sulfur.

16. A light-sensitive silver halide photographic material according to claim 1, wherein each of $X^1$ and $X^2$ in the formulae (XI), (XII) and (XIII) is oxygen, and each Y in the formulae (XI), (XII) and (XIII) is sulfur.

17. A light-sensitive silver halide photographic material according to claim 1, wherein each M in the formulae (XI), (XII) and (XIII) is a transition metal.

18. A light-sensitive silver halide photographic material according to claim 1, wherein each M in the formulae (XI), (XII) and (XIII) is nickel.

19. A light-sensitive silver halide photographic material according to claim 1, wherein $R^1$ and $R^2$; and $R^3$ and $R^4$ in the formulae (XI), (XII) and (XIII) are groups forming benzene rings.

20. A light-sensitive silver halide photographic material according to claim 1, wherein the compound represented by the formula (XXI) has the following formula:

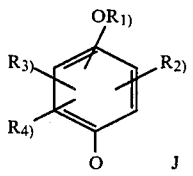

wherein $R_{1)}$, $R_{2)}$, $R_{3)}$, $R_{4)}$ and J have the same meanings as in the formula (XXI).

21. A light-sensitive silver halide photographic material according to claim 1, wherein the amount of the compounds represented by the formulae (XXI), (XXII) and (XXIII) is 0.01 to 1.0 mole per mole of the coupler.

22. A light-sensitive silver halide photographic material according to claim 1, wherein the amount of the coupler represented by the formula (I) is within the range of from $1\times10^{-3}$ mole to $5\times10^{-1}$ mole per mole of the silver halide, the amount of the compound represented by the formulae (XI), (XII) and (XIII) is 5 to 100% by weight based on the amount of coupler present, and the amount of the compound represented by the formulae (XXI), (XXII) and (XXIII) is 0.01 to 1 mole per mole of coupler present.

23. A light-sensitive silver halide photographic material according to claim 1 wherein said coupler is a compound having the formula VIII

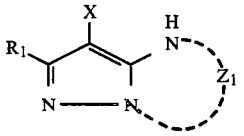

(VIII)

wherein $R_1$, X and $Z_1$ have the same meanings as R, X and Z., wherein said compound represented by at least one of said formulae (XI), (XII) and (XIII) is a nickel compound and wherein said compound represented by at least one of said formulae (XXI), (XXII) and (XXIII) is a compound having the formula:

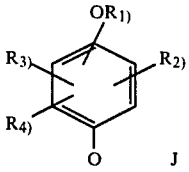

wherein $R_{1)}$, $R_{2)}$, $R_{3)}$, $R_{4)}$ and J are as above defined.

24. A light-sensitive silver halide photographic material according to claim 2 wherein said compound represented by at least one of said formulae (XI), (XII) and (XIII) is a nickel compound and wherein said compound represented by at least one of said formulae (XXI), (XXII) and (XXIII) is a compound having the formula:

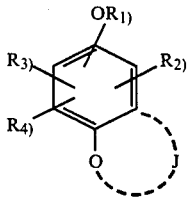

wherein $R_{1)}$, $R_{2)}$, $R_{3)}$, $R_{4)}$ and J are as above defined.

* * * * *